US008556264B2

(12) United States Patent
Benedict, III

(10) Patent No.: US 8,556,264 B2
(45) Date of Patent: Oct. 15, 2013

(54) CLOSABLE-TYPE GAME BOARD FOR BASIC SYMBOL RECOGNITION

(76) Inventor: Milner Benedict, III, Tampa, FL (US)

( * ) Notice: Subject to any disclaimer, the term of this patent is extended or adjusted under 35 U.S.C. 154(b) by 86 days.

(21) Appl. No.: 13/317,491

(22) Filed: Oct. 19, 2011

(65) Prior Publication Data

US 2013/0099446 A1 Apr. 25, 2013

(51) Int. Cl.
*A63F 3/00* (2006.01)

(52) U.S. Cl.
USPC ..... 273/272; 273/265

(58) Field of Classification Search
USPC ..... 273/265, 272, 299
See application file for complete search history.

(56) References Cited

U.S. PATENT DOCUMENTS

| | | | | | |
|---|---|---|---|---|---|
| 2,053,598 | A | * | 9/1936 | Blau | 273/265 |
| 2,794,641 | A | * | 6/1957 | Baker | 273/265 |
| 3,514,110 | A | * | 5/1970 | Thomander | 273/265 |
| 4,059,273 | A | * | 11/1977 | Kindred | 273/265 |
| 4,188,036 | A | * | 2/1980 | Jones-Fenleigh | 273/265 |
| 4,194,742 | A | * | 3/1980 | Adams | 273/265 |
| 4,801,148 | A | * | 1/1989 | Lamb | 273/255 |
| 5,154,428 | A | * | 10/1992 | Woolhouse | 273/265 |
| D536,039 | S | * | 1/2007 | Creech | D21/335 |
| D601,204 | S | * | 9/2009 | DeOreo et al. | D21/335 |

* cited by examiner

*Primary Examiner* — William Pierce

(57) ABSTRACT

My child educational board game, "Word Battle Junior", embodies a configuration requiring players to approach the fundamentals of literacy and numeracy by simply calling out spaces in a competition of take away so that, once all prepositioned and hidden game elements on opponents' targeted regions are found, the last player with symbol marked blocks in his/her playing field wins.

9 Claims, 33 Drawing Sheets

Player B

Player B

Player B

Player B

CLOSABLE-TYPE GAME BOARD FOR BASIC SYMBOL RECOGNITION

CROSS-REFERENCED TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION (1) Field of the Invention

This invention involves a game of basic symbol recognition. It can be played between two opponents or among three or more opponents. The goal in and of itself is to be the last remaining player with marked rectangular blocks in his/her action field.

The purpose of this invention is educational in nature. It aims to introduce a fun and engaging way for preschool to primary aged children to gain mastery over the foundational concepts needed for later school success. These include letters, shapes, colors and numbers—the basis of literacy and numeracy.

Because of the generic framework of this invention, it may be adapted to any language or regional dialect therein, which includes Indo-European, African, Asian, and Pacific Island, as well as any others not mentioned here.

The invention barrows an element from a previously patented work (see Benedict III, U.S. Pat. No. 7,665,735 B2) that enables individual players to each use a modified game board, allowing multiple players to compete at once. What is presented here, however, incorporates fundamental differences which make this application new and unique.

The disclosed comprises two rectangular boards which are hinged together. When opened to an approximate ninety degree angle, three grids are revealed—one inside the apparatus on a bottom board, one inside the apparatus underneath a lid, and one outer grid which is on top of a lid.

The outer grid, visible to all other opponents, is the key element barrowed and integrated into this invention. However, what is different in this disclosure is that each of the coordinates in the two grids on either side of the top vertical board has an aperture. In other words, the individual coordinates have rectangular holes which appear all the way through the vertical board. This allows rectangular blocks, of which there are several sets, to be inserted into the coordinate spaces of the upper board. As coordinates are called, the prepositioned blocks in a top vertical board grid are ultimately pushed entirely through and ejected out the other side as new ones are transferred from the bottom board grid and inserted in their place. Further, the individual coordinates of the bottom grid field are apertured so that game blocks may be inserted into those coordinates, just as with the vertical board. Unlike the vertical board I, however, a flat panel III is attached to the underside of the bottom board II. This prevents blocks from passing all the way through the bottom (FIG. 4).

The game, as defined by the invented apparatus, while retaining aspects of similar commercial products, is characterized by its emphasis on interplay among rectangular blocks into a closable-type board. This enhances the game's ability to achieve and maintain participation in several respects:

(1) By requiring the child to give consideration on where to place marked blocks in a bottom grid so as to delay or prevent opponent(s) discovering them;

(2) By utilizing oversized pieces, or rectangular blocks, making it easier for children to grasp and manipulate them during course of play, thus providing a level of direct, tactile stimulation for the child;

(3) By providing a chart that illustrates the symbols found on the targeted blocks which the players are trying to discover from an opponent's concealed bottom action grid, and (4) By providing a rectangular game board that allows players to insert rectangular blocks all the way through coordinates of an upper, vertical rectangular grid so that, as spaces are selected, blocks occupying coordinates on a bottom grid are transferred to the corresponding coordinates of an upper grid and inserted into those spaces, thus pushing the block that was prepositioned there out the opposite side. This key quality adds a level of interaction which is new and apart from what is found in Benedict III, U.S. Pat. No. 7,665,735 B2.

The disclosed invention may currently be classified under class 273, which identifies various amusement game devices. More specifically, the disclosed is a competition of take away, where game elements, or blocks, are prepositioned on a hidden, bottom action area prior to play. Then, each contestant selects a coordinate, one move at a time, which results in shifting of rectangular blocks into out-of-play positions on an upper, vertical board. The game ends when one of the players removes the last block from a hidden, bottom board of an opponent—thus resulting in a win for a player who is the last with rectangular symbol marked blocks remaining in his/her bottom grid. The game may therefore be considered a Nim type, which currently falls under subclass 266.

It should be noted that there are two general categories from which this disclosure is derived: First, games that require a level of skill and knowledge for logical reasoning, and second, games that do not assume such requisite ability. Further, there are Salvo-type games that relate to aspects of simulated warfare, and Nim-type games that are based on removal of game elements. Additionally, for children, there are games which use blocks for basic play. Nim and Salvo may be thought of as representing stages where competitions serve to introduce the building blocks for a foundation in reasoning skills. It is a given that these games ultimately led to the educational tool cited in Benedict III which enables multiplayer competition within a Salvo-type design.

Demonstration of vocabulary and other knowledge are not generally assumed with Nim games. Therefore, it would be appropriate to develop a disclosure that acts as a bridge from rudimentary to more challenging games which instill and cultivate recognition of symbols such as letters, shapes, colors and numbers—the foundation of literacy and numeracy needed for life success.

There are, of course, many related configurations in the prior art which touch on literacy and numeracy. But adding such games into a board design that utilizes three separate playing fields stimulates a level of reasoning for preschoolers not typically possible. This disclosure now discusses the prior art in illustrating this point.

(2) Description of Related Prior Art

In discussing this invention, it is important to recognize that several pertinent types of game board configurations have been granted full patent status. These patents of the prior art can be divided into related categories, all of which contrast them from the present invention and serve as a progression in the stages of game development which have led to the current disclosure. Hence, the full merit of this new game board is validated.

Games of the prior art have required skill in placement of pieces in such a way as to delay opponents successfully targeting and eliminating them. Players also use sequencing skills to guess what chips, such as letters, come in any particular order based on logical word spelling. This is why such games, and specifically those of word discovery, could fall into a category of salvo, as players try to eliminate opponent's "fleet" of words in those competitions.

In providing a perspective on the value of the currently disclosed invention, several categories of amusement games are detailed. The first is in regard to the art proceeding Benedict III in U.S. Pat. No. 7,665,735 B2. This section discusses two player games of the salvo and word discovery types. The next section briefly examines how Benedict III reconfigures games of the prior art so as to allow three or more players to compete at once in a modified board format. Thus, Benedict III is the dividing line between prior designs and a single apparatus which allows for, conceivably, unlimited numbers of opponents.

Following Benedict III is a discussion of games in regard to Nim and other competitions which use blocks. The point here is to show what games have utilized qualities which make them appealing and how elements of these are found in the currently disclosed invention.

Last, the application points to a problem of the prior art: notably, that these inventions are aimed at participants around middle childhood and do not particularly allow for play among younger, primary aged children. As already stated, this can be achieved by having an upper, vertical board where blocks can be pushed entirely through one side and ejected out the opposite side. This has the effect of bringing more advanced contests down to a level playable for preschoolers. Thus, readers of this disclosure should be able to follow the path which naturally illustrates the reason for this application, the "Closable-Type Game Board for Basic Symbol Recognition".

Part I

Games for 2 Players (A) Salvo (i) Closable Type with 2 Grids

The first category for discussion regards salvo games which allow for a maximum of two players in any given competition. In this embodiment, each contestant utilizes a game board that remains closed when not in use. When the board is opened up for competition, two grids utilized as playing fields are revealed which are somewhat perpendicular to each other. These boards remain connected via a hinge on one side.

Competition involves players calling out coordinates in turn. The objective is to guess which spaces on opponent's targeted action area grid are occupied with pieces. There are several examples of this style of game apparatus.

E. E. Blau in U.S. Pat. No. 2,053,598 demonstrates a game that comprises two flat boards each holding identical playing fields with sockets for receiving and removing pegs and other naval pieces such as warships. These boards are hinged together, allowing for the apparatus to be closed and then opened for play. The playing field located on the upright vertical board is the shooting area. It is revealed when swung to a raised position with regard to the horizontal target board. The target board is an action area playing field onto which he/she places his/her own game pieces. The game pieces on the target board are the objective for elimination by the opponent. The target board rests on a flat surface such as a table, giving the entire apparatus a stable hold for play.

E. J. Adams in U.S. Pat. No. 4,194,742 demonstrates a game board related to Blau with one notable difference: game pieces representing land masses are provided which fit onto the action area, which is referred to in Adams as a playboard, grid coordinates. This invention embodies an integration of geography onto the game apparatus more approximating salvo warfare. Also, Adams provides storage bins on either side of the playboard action area which may be divided into smaller compartments. This apparatus allows for two opponents per competition.

A. B. Thomander in U.S. Pat. No. 3,514,110 demonstrates essentially two variations of the two grid fields salvo type foldable game board. The first variety is unremarkable from the one presented in Adams. However, the second variety demonstrates a flat board divided into a pair of identical sections adapted to be arranged adjacent to each other. One section of the flat board is the action area marked "Home Fleet". The second is the record area marked "Enemy Fleet". In addition, there is a "Score Area" into which a player marks hits that have been made against the opponent. These hits are also recorded in the "Enemy Fleet" board.

Each player uses a flat game board identical in the characteristics just mentioned. These two boards are separated by an upright barrier that obscures the selected placement of ferruled game pieces on each of the boards from the view of the opponent. A player calls out coordinates, with "hit" and "miss" attempts recorded appropriately until all targets have been eliminated by one of the two players.

(ii) 2 Game Boards Attached Together

Another category regards salvo games that also allow for a maximum of two players in any given competition. First, there is the standard apparatus with two playing fields visible to a contestant. However, in this style, the two apparatuses are attached to one another. In other words, instead of having two separate apparatuses, the backs of each vertical board of the two apparatuses are joined together. The horizontal bottom playing boards can then be folded up, enabling a single assembly, presumably to allow for ease of transport. Three patents of the prior art relate to this characteristic.

D. J. Lamb in U.S. Pat. No. 4,801,148 demonstrates a game of tactical strategy where a mounting structure is used for maintaining vertically disposed maneuvering boards in a back-to-back relationship. FIG. 5 of this patent illustrates this assembly. Further, there are a plurality of game pieces and maps and transparent grid sheets which may be used in the playing fields themselves, adding a degree of complexity to Lamb.

C. J. Woolhouse in U.S. Pat. No. 5,154,428 demonstrates two playing fields, each composed of a pair of sectioned grid areas, that are mounted together in a way that provides for ease of assembly and disassembly into a carrying case for transport.

Of course, these games find their origin in "Battleship"—a pencil and paper game invented by Clifford Von Wickler and then formally published as a pad and pencil game by Milton Bradley in 1943. These games have been restricted to competition between two players (see http://en.wikipedia.org/wiki/Battleship_(game)).

As can be seen from this discussion on Salvo games of the closable two grid type, the general embodiment that the previous art has presented in this category is a format that directly touches on a basic game board that is made up of two boards hinged together. This disclosure shows how the game device can be brought down to a level playable for preschoolers. A survey regarding games with multiple playing fields now follows to relate competitions made up of several playing areas.

(B) Multiple Level Game Board

A category of game board approaches the salvo-type and offers more than two playing fields where two opponents compete. These multi-level game boards are known in the prior art as devices allowing for simulated battle in play. Several examples demonstrate this category.

Harper et al demonstrates in patent number U.S. Pat. No. 3,767,201 a multi-level game board arranged for three dimensional chess or checkers game play.

Brennan demonstrates in patent number U.S. Pat. No. 3,937,471 a multiple board chess game with added play pieces.

Mayfield et al. in U.S. Pat. No. 5,443,268 demonstrates a game with three checker grid boards that are stacked, one above the other, and connected to a vertical pedestal. Two opposing players are assigned to move game pieces per board, therefore allowing for a total of six players to compete. These players are grouped into two opposing teams who utilize armament pieces different from prior games.

As can be seen from this discussion, inventors have created games that indeed use three grids, but in a completely different configuration from the current disclosure. Therefore, unlimited numbers of contestants are precluded from play. There are, however, flat boards which allow several players, but are still limited in the total number of potential contestants.

(C) Single Level Game Board for Multiplayers

Another type of multiplayer board regards a game with a single, flat central playing field whereupon opponents engage one another for the purpose of elimination of the opponents' pieces.

S. Shkolnik demonstrates in U.S. Pat. No. 3,840,237 three participants who engage one another for the purpose of checkmating the two other opponents. This is done on a central, six-sided board that has three sides for directly playing the game.

Of course, a game board of the prior art relates to Chinese Checkers. This is a flat board that can be played by a maximum of six people. However, five people cannot play. The objective, unlike salvo, is to be the first to place one's pieces in the corner opposite their starting position. This board is apertured into a hexagram. Single moves or jumps over other pieces are allowed in competition (see http://en.wikipedia.org/wiki/Chinese_checkers).

A variation of Chinese Checkers is demonstrated by Wendy Ko in patent number U.S. D450,779 S. This game board is an ornamental design that allows it to be folded up with a fastener.

The first several parts of this survey have related to Salvo type games. As the currently disclosed invention relates elements of literacy, it is important to see what discovery type word competitions exist. This shows the development that led to Benedict III regarding a closable type game board box featuring three grids—the basis of the new invention disclosed here.

(D) Discovery—Type Word Games

A category relevant to the prior art involves games where the general strategic objective is a "hit" or "miss" of targets between two players, but which focus on words and their component letters as opposed to military or naval units. The manner of play may vary among various word forming type games, but their underlying theme is to create, strategize toward, discover and solve for words.

An example is demonstrated by M. Kindred in U.S. Pat. No. 4,059,273. Here, a game board is set forth that has twenty-six rows of playing areas arranged in five columns. Playing pieces are placed into the resulting spaces. An opponent attempts to break a hidden code formed by the pieces. The rows are numbered A through Z and the attempts are scores according to the nearness to an accurate guess by the player. The code has five such letters forming a word, one letter per column.

Another example is demonstrated by E. J. Jones-Fenleigh in U.S. Pat. No. 4,188,036 which sets forth a game comprising a board, a holder, a set of playing pieces, a set of marking elements, a set of scoring elements and a word list. The board has a number of rows of playing areas which serve as test areas for a player's attempts in duplicating a hidden code word chosen by the player's opponent. The game is played with the intention of achieving a set number of points, agreed upon prior to game start, for an equal number of rounds played.

As has been established here, while military/naval style games have been provided where participants strategically place valued pieces in coordinate grids and attempt to locate and eliminate one another's pieces within a defined area, and while there are various word forming type games whose underlying theme is creating, strategizing toward, solving for and discovering words and their component letters, it is important to note that games have been provided regarding the injection of letters, instead of military or naval units, into a grid coordinate system so as to represent a "fleet" of words for elimination by an opponent. Several games have been published online which provide set-up instructions and rules for such competitions.

(E) Combination Salvo—Word Discovery Type http://www.superteacherideas.com/spelling2-battleship.html demonstrates the game activity "Sink and Spell" where students make a sheet with two grids. Letters are written on the top and numbers to the side for coordinate identification. The players then write words into the grids. Coordinates are called out. A miss indicates no letter in a particular space, but a hit results in the opponent revealing the letter. This game is played by a pair of opponents.

Another example posted on this website, "Battleship Spelling", is a more detailed version of "Sink and Spell" with guidelines regarding number of words to use and dimensions of paper sheets on which to create the grids. The listing actually states that this is "just like the Battleship board game".

Http://www.lessonplanspage.com/LASpellBattleship3JH.htm, posts "Spelling Battleship" with the rule that once there is a "hit" on any particular coordinate, the opponent is immediately told the word and he/she then has to spell it correctly. If that player correctly spells the word, he/she gets a point and the word is revealed in its entirety; otherwise the turn is lost. That player, however, may reattempt the spelling on the next turn by calling the space coordinate. The first player to locate and spell all the words on his/her opponent's grid wins.

It is clear that an advantage of military/naval style games of the prior art has been developing within players the skills important for tracking dispersal of attacks over a coordinate system and anticipating where the next "hits" could be. This advantage was constrained, however, in that they engage players on mere hit-or-miss cues, limiting assessments to success:failure ratios between opponents' progress against one another's targets. Advantages of word games of the prior art encourage players to develop spelling abilities for accurate vocabulary usage, as well as to figure out how words are encoded into language, their meanings, and differences in relation to one another for the ultimate objective of communication.

The prior art discussed in this analysis shows how these two key features: (1) initiating, tracking, and assessing the success or failure in targeting unknown pre-positioned objectives within a military/naval style grid coordinate type system, and (2) creating and solving for words in a puzzle type environment, have been combined by inventors to create innovative games. Substituting words and their respective letters for military/naval units into the typical coordinate grid system of a sectioned, visually hidden region is a clear advantage of such inventions. The result is an expansion of the identifiable qualities of each occupied coordinate so that, once a space is determined to be occupied, arbitrary guesses leading to more calculated judgments can be taken, thus bringing a mere salvo objective to one where vocabulary can increase the necessity for higher logic and sequencing skills.

With this said, a key disadvantage of previously provided word-salvo games was their allowance for a maximum of two players in any competition. They were thus limited in the scope of complexity which could have been achieved through three or more opponent play. This problem was overcome by Benedict III in U.S. Pat. No. 7,665,735 B2.

Part II

Multiplayer Word Salvo Type Game Board

Benedict demonstrates an embodiment of the abovementioned salvo play board with an addition that makes multiple player word discovery games possible. The basis of that patent is placement of a grid on top of a game board lid. When opened, so that the lid is in a ninety degree angle from the base, three playing fields are revealed. These are utilized during competition, allowing three or more opponents to participate at once. This is a novel approach to the related prior art, because game boards always had some set limit to the total number of allowed players. No previous design has enabled play for, conceivably, unlimited numbers of contestants.

Part III

Nim

The game categorized as Nim is a competition of strategy where two players take turns by picking up pieces from a group or set of contest elements. In normal, conventional play, the objective is to be the first to remove all targeted pieces. Alternatively, in Nim the player to take the last object loses.

It is believed, though not entirely certain, that the game of Nim originated in China. The term itself was coined by Charles L. Bouton of Harvard University, with its derivation relating to Nimm, which means "take" in German. The word is also related to the obsolete English verb Nim, which means "take" (see http://en.wikipedia.org/wiki/Nim_Game).

The first game of this category is in regard to Benatti, U.S. Pat. No. 6,155,566. This publication describes two identical play boards, each with a pair of playing positions arranged in rows that form two triangular patterns, with the two patterns coming together at a central row comprising at least one play position. The play positions are shallow depressions into which pieces are placed.

Essentially, two opponents take turns in compelling the other to move his or her pieces onto the second play board. The winner is the one who forces his/her opponent to move the last piece from one play board to the second.

Another example of Nim is presented by Kunik et al in U.S. Pat. No. 3,708,171. In that publication, the inventors propose a flat game board having a plurality of circular apertures. Disc game pieces are then placed into the apertures. These disc pieces are rotatable into either "in play" or "out of play" positions. Two players alternate in moving the pieces, one at a time per turn. The player who plays last and leaves one remaining game disc piece "in play" wins the game.

What is important to understand here is that each of these Nim games focuses on the objective of moving, or remaining in place, the last game element in a board competition. This aspect is similar to the current disclosure in that, as the reader will see, the game requires moving of the last rectangular symbol marked block into an out of play position, in an upper vertical playing field. It is this feature which lends the invention to a category of Nim games.

Part IV

Games and Blocks

Games which incorporate blocks marked with various indicia have played an important role in child development. Such embodiments of the prior art are used both by parents and educators to teach the foundational concepts needed in communication and computation, as well as in general life functioning. As the reader will note in the following, games and blocks represent a category of innovation which naturally lead to the currently disclosed game board design.

Crowe teaches in U.S. Pat. No. 5,092,777 a game for players to learn the correct sequence of letters in the alphabet. Crowe's first design refers to a set of blocks where each side is marked with a letter. Further, two sides of a block have indicia indicating the preceding letters, and the other two sides have indicia indicating the succeeding letters.

According to Crowe, the game may be played by one to eight opponents. The blocks are placed on a flat surface. The player first to identify the preceding or succeeding letter of the alphabet relative to the indicia on the selected block wins a point. The first opponent to score a predetermined number of points wins the game.

Another invention which uses blocks is presented by Bez in U.S. Pat. No. 5,139,271. Bez teaches a word game where each player is represented by a set of colored alphabet blocks, which they select prior to game start. The objective is to travel up and across a board by forming words while using one letter from a previous word. As this is done, the used letter is substituted by another from a surplus supply tray. The winner is the first to reach the top of the game board, or the one having the most letters in his/her color goal if more than one player reaches the top in a round. Therefore, this game utilizes blocks with words and colors, which reflects aspects of the prior art that the current disclosure demonstrates.

Roche teaches in U.S. Pat. No. 4,286,952 a rectangular opened-top box. Removable boards may be placed into the box, followed by a grate which allows for rectangular blocks of different colors and lengths to be placed into the sockets of the grate. The objective of this device is to teach a child to recognize similarities and differences in distances, and similarities and differences in sizes and shapes of objects, and to recognize colors. This objective is accomplished by having the child look through openings in the grate to determine the height of the platform below. Blocks are then inserted, whereupon the child can experiment by removing and reinserting the blocks to see how the differences in length affect their fit into the sockets. A removable board with colors on its surface may be inserted into the box, followed by a grate, whereupon a child matches the colored blocks with what he/she sees through the grate sockets. Hence, this invention introduces a child to concepts which are the building blocks for later school success, and which therefore embodies a related tool of the prior art.

Another invention to be discussed comes from Wise in U.S. Pat. No. 2,899,756. Wise provides a device for teaching arithmetic operations to students of appropriate age to test and familiarize them with such concepts. The invention is essentially a rectangular horizontal board with a rectangular indentation allowing for rectangular cards to be fitted into the indentation of the board. The cards list mathematical problems. Each problem is printed and divided into sectioned units. An example of such a card would be a multiplication table listing operations 1×1 through 9×9, as provided by Wise. Further, rectangular blocks are presented which are marked with the answers to the mathematical problems.

The objective of a player is to match the numbers, which are the solutions, on the rectangular blocks with the problems listed on the card. This is done by placing the correct block, one at a time, onto the appropriate space. Answer cards are provided to check if he/she has gotten the placements correct.

The invention presented by Wise does not directly reflect what is given in the current disclosure. However, it does show the importance of using blocks in a teaching method. Further, Wise sets up an important question. How can the fundamentals for later educational success be introduced to preschoolers? The whole process of introducing numbers, if done in an engaging and fun way, can lead to intrinsic rewards which carry a person beyond school. It is therefore worthwhile to consider how a game could serve as such a learning tool, which, again, leads to the disclosure of this invention.

In U.S. Pat. No. 3,427,028, Abrahamsen teaches an invention with two embodiments. The first comprises a vertically disposed playing board resembling that of a grid. The second embodiment holds multiple panels appearing as rectangular grids, each attached to the others on one side, which are disposed at preferably equal angles from each other. This allows each player to be pitted against two opponents. Also provided are playing pieces which are marked with letters, with the same letter duplicated on either end. The objective is to build words in lateral directions while frustrating words which have already been completed in the opposite directions by opposing players. Points are scored with each word built into the grid per turn, with the winner presumably being the one with the most points at the end of the game.

As can be seen from this analysis, the use of individual letters is an aspect which touches on the currently disclosed invention. Many games of the prior art have, in fact, touched on elements of Nim, Salvo, numbers, word discovery, blocks and multiple players. The problem, however, is that these games are naturally restricted to children of ages eight and older. The question arises: Is there a way to bring a word salvo multiplayer configuration found in Benedict III down to a level that incorporates elements of Nim and block competition where boys and girls as early as age four could play? The problem of how to accomplish this is addressed in the following.

BRIEF SUMMARY OF THE INVENTION

Whereas the prior art focuses on elimination of prearranged words or other marked game pieces, and configurations thereabouts, the disclosed invention of this application functions merely to have players select spaces, which in turn reveals game elements prearranged on the opponent's bottom action area playing field. This reduces the apparatus to a hit-or-miss competition while getting children to recognize the basic symbols of literacy and numeracy.

It is therefore accordingly an object of the present invention to provide a game of take away which avoids the aforementioned problem of the prior art—that being a multiplayer board that does not easily assimilate into the criteria needed for an age-appropriate competition among preschool/primary level children. In other words, this disclosure brings the multiplayer word salvo type game down to a point where it is playable for younger boys and girls.

The primary way in which this invention holds interest for children, which allows it to overcome the just mentioned problem, comes when over-sized game blocks are selected from the bottom action area playing field and pushed into the corresponding space on the upper, vertical portion of the game board. When this happens, children see the action that results from their selection of a space, regardless of outcome. If a selection in fact reveals a symbol marked game block, then the child experiences all the more enthusiasm for learning, especially when players can compare and contrast which symbols discovered match those provided on a chart.

Having a game device where game elements can be inserted and pushed all the way through the vertical portion of the apparatus achieves an engaging level of interaction for the child. Hence, the full merit of the invention presented here is established.

It is also an object of the present invention to provide a Nim game that overcomes an additional problem of the prior art—this being the restriction of a typical game to a certain number of players. Having an apparatus with three playing fields allows an unlimited number of opponents to compete at once. This essentially brings the typical Nim game up to a point where it meets the category of a multiplayer word salvo discovery, yet is completely playable for preschooler and primary age children.

A further object of the present invention is to act as an introduction to higher stages of games which educators utilize in teaching school curricula. Such games require more advanced levels of reasoning and knowledge. These involve salvo, word discovery, and an integration of both (see Benedict III, U.S. Pat. No. 7,665,735 B2), as well as various games of numbers and logic. By redesigning Benedict III in a way that maintains the advantage of allowing multiple contestants, yet simplifies it so as to be useful for preschool education, the currently disclosed invention fosters and accelerates the assimilation of the basic symbols knowledge needed for mastery of literacy and numeracy.

Still further, it is an object of the present disclosure to provide a game which is an age appropriate competition aimed at four year old children, but which can be modified in play so as to be age appropriate for six year old children.

Furthermore, the object of the present invention is to provide a closable-type game board which opens to an angle that is approximately ninety degrees, allowing the base to rest upon a flat surface. When brought together with other closeable-type apparatuses, the invention may enable two or more individual players to arrange blocks marked with the symbols of basic literacy and numeracy on the bottom action area playing fields of their game boards, along with other block types. The last remaining player with marked game blocks in his/her bottom action area grid wins the game.

The advantages of the game which are the object of the present invention are the following:

The child is introduced to critical thinking skills by requiring him/her to think about where targeted game elements may be by simply selecting spaces and seeing what pieces are revealed;

The fundamentals of spelling, vocabulary and other related knowledge are strengthened in getting the child accustomed to simply seeing letters, numbers, shapes or colors revealed in the course of play;

Educators can introduce the fundamentals of literacy and numeracy by using the disclosed invention as a game appropriate to four year old children, but then modify the game in a way that allows six year old children to use their knowledge in deducing, through process of elimination, what symbols actually occupy spaces, as opposed to simply selecting coordinates in a "hit" or "miss" fashion, and a child is introduced to multi-tasking skills by requiring him/her to take a "bird's eye" approach in visually assessing the status of opponents' pieces on their playing fields, thus giving the player not only a head start in winning the game, but a head start in winning at life.

BRIEF DESCRIPTION OF SEVERAL VIEWS OF THE DRAWINGS

The present invention is further described hereinafter with reference to the parts, their assembly and relationships, shown in the accompanying drawings, in which.

DETAILED DESCRIPTION OF THE INVENTION

As can be seen from the above figures, the game apparatus (FIG. 5 and FIG. 6) comprises two rectangular shaped boards of congruent dimensions. One of these functions as a bottom board II and the second functions as an upper, vertical board I, which may be thought of as a lid. These are hinged together on one side, allowing the two boards to be closed in a perfect fit (FIG. 7). When opened to an approximate ninety degree angle, the device may rest flat upon a surface for play. Play is accomplished through the use of three grids which are revealed when the upper board I is raised to a ninety degree angle with respect to the bottom horizontal board II. There is one playing field grid inside the apparatus on a bottom board (FIG. 5), one inside the apparatus on an upper, vertical board underneath a lid (FIG. 5), and one located on top of a lid (FIG. 6). The two inside grids are playing fields which are intended to be visible only to an individual participant during competition. The outer grid is a playing field visible to all other opponents during competition.

The grid inside the apparatus on a bottom board (FIG. 5) may be thought of as a bottom action area playing field, and will be referred to as such through the duration of this application. The grid, or playing field, located inside the apparatus underneath a lid (FIG. 5) and the outer grid, or playing field, located on top of a lid (FIG. 6), along with the bottom action area playing field, are all of rectangular dimensions congruent to one another in height, length, and width, as well as in the total number of unit spaces each grid holds.

The playing field underneath a lid (FIG. 5), whose height 9 measures a size of approximately between 0.1 and 50 inches and whose length 8 measures a size of approximately between 0.1 and 50 inches, is the region into which black rectangular blocks 13 are inserted prior to game start. Sixteen of these blocks are prepositioned into the upper, vertical grid before beginning. It should be noted that the individual coordinates of the playing field underneath a lid are apertured entirely through the upper, vertical board. This allows game blocks to be inserted and pushed all the way through and ejected out the opposite side of the corresponding coordinate in the outer playing field.

Figure 1:
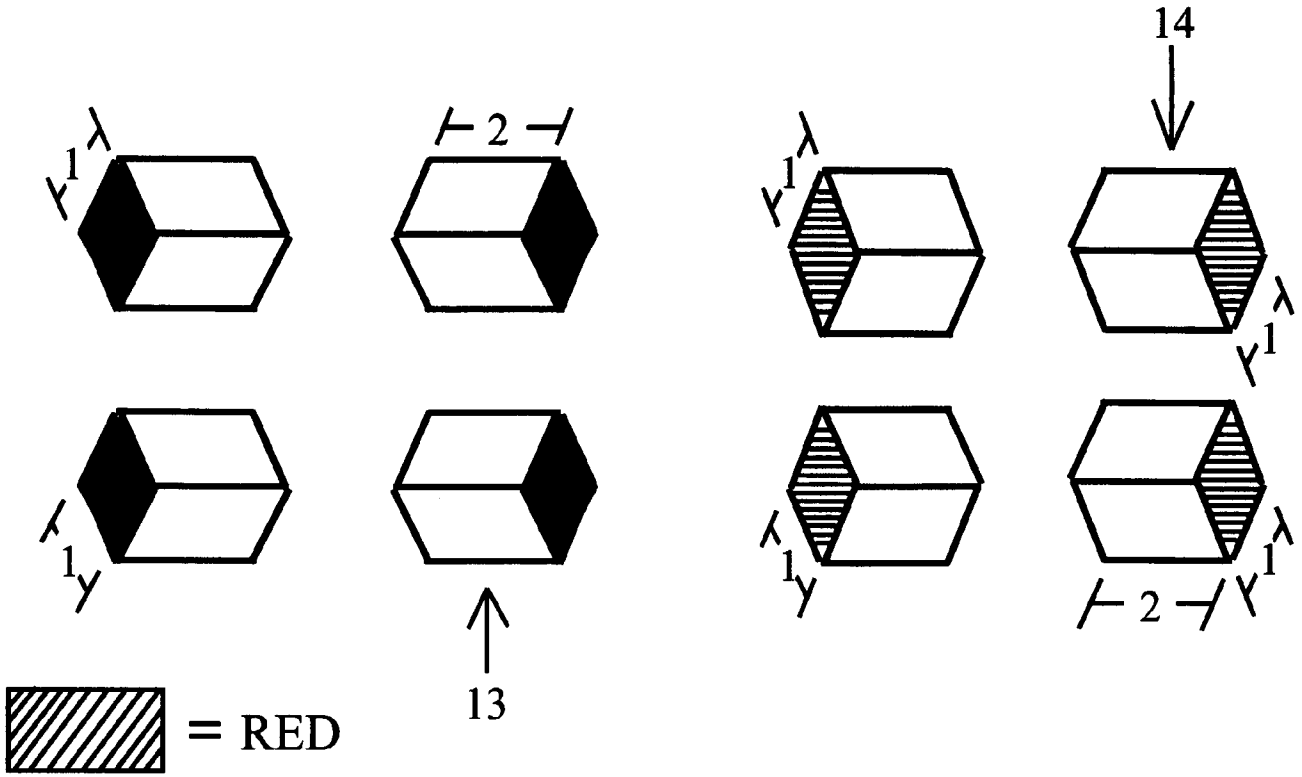
FIG. 1 represents two of the three sets of rectangular blocks used as game pieces, with a black marked rectangular block numbered as 13 and a red marked rectangular block marked as 14 for the purpose of reference in this application.
Figure 2:
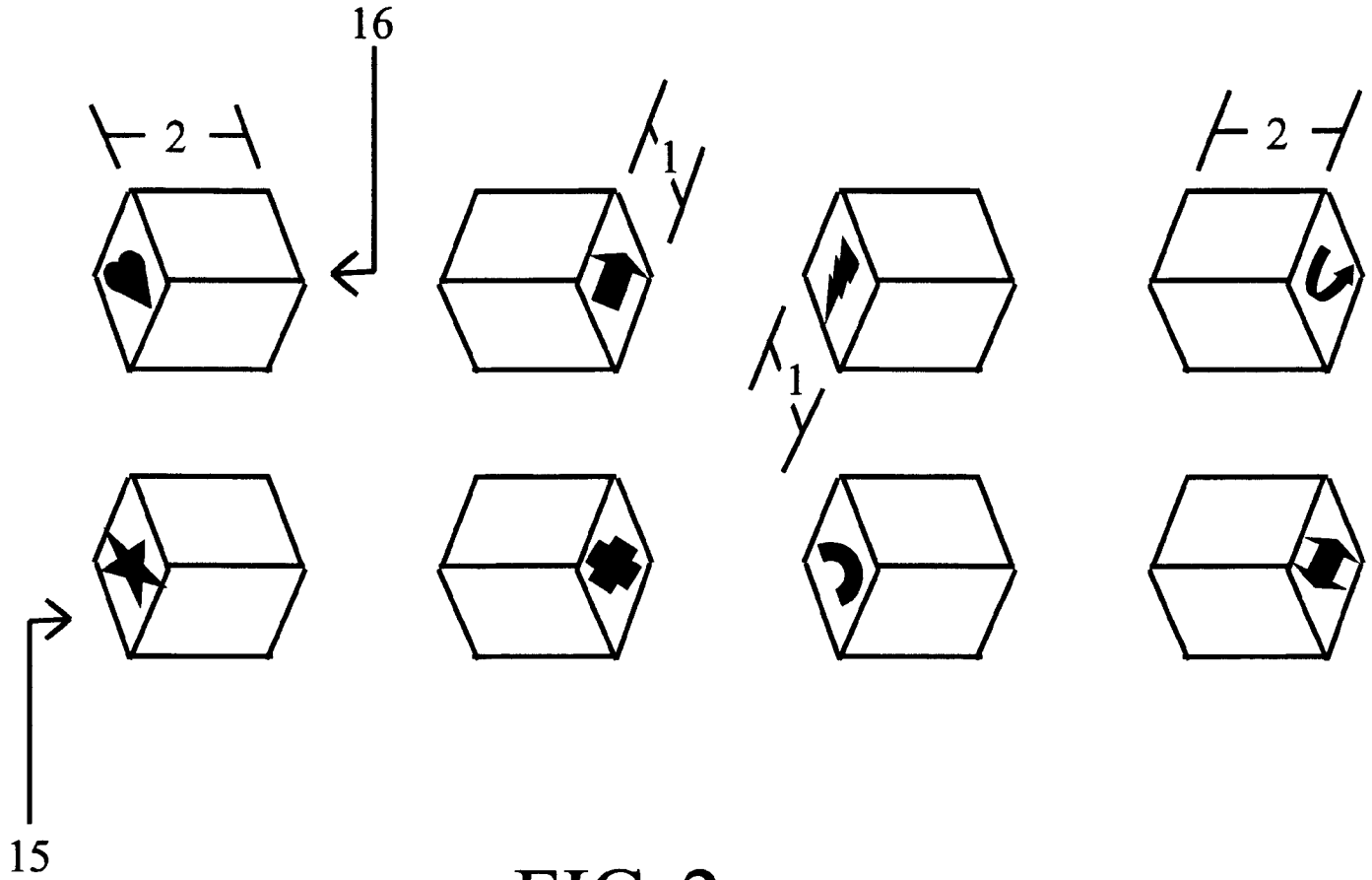
FIG. 2 represents the third set of rectangular blocks used as game pieces which are imprinted with shapes, with game block number 15 illustrating a star marked piece and game block number 16 illustrating a heart marked piece for the purpose of reference in this application.
Figure 3:
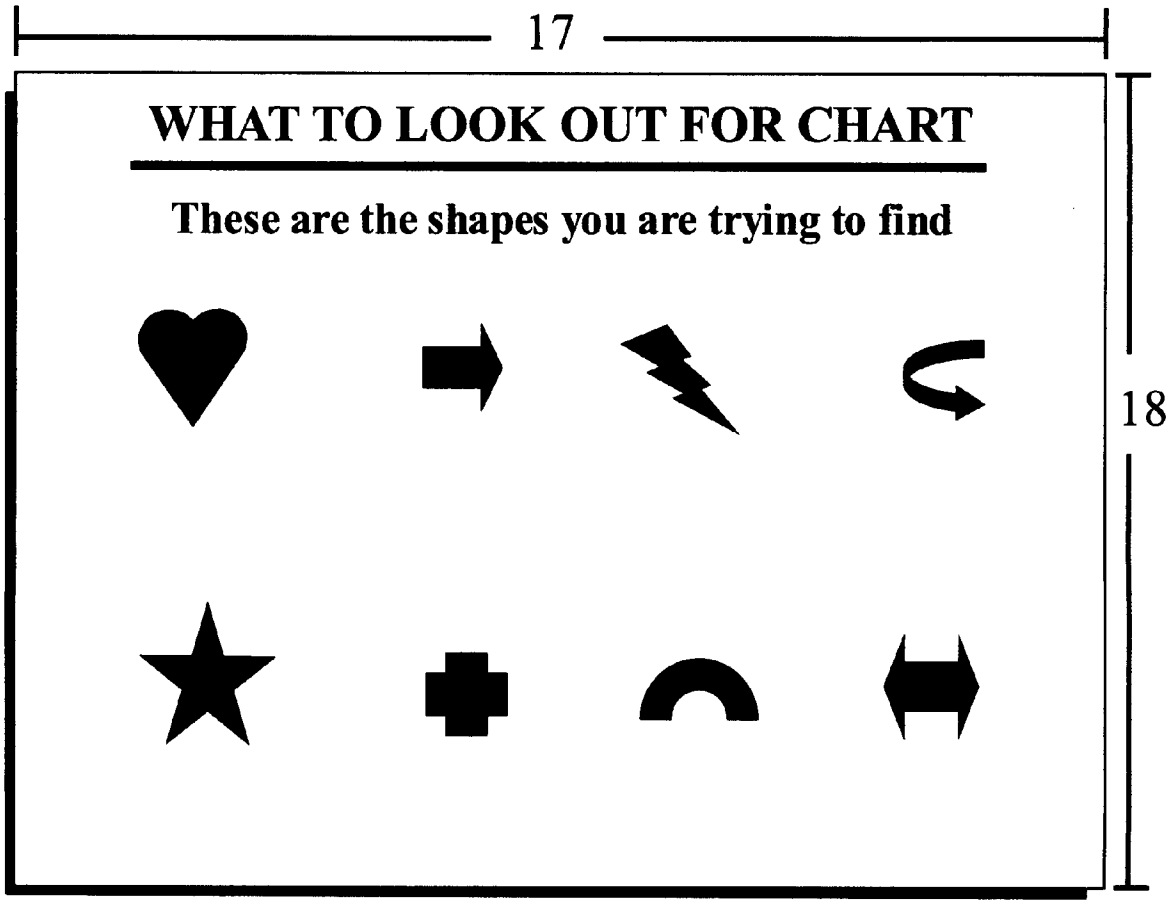
FIG. 3 represents a chart which presents pictures of all the shapes which any given player is trying to find during the course of play.
Figure 4:
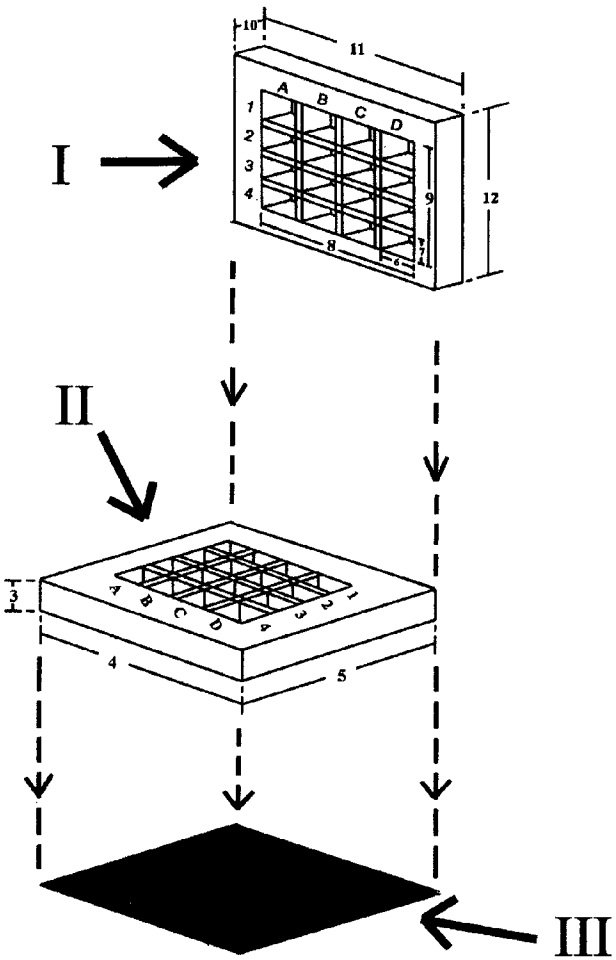
FIG. 4 represents the three parts to the closable-type game board, with I representing the upper board, II representing the bottom board, and III representing the flat panel attached to the underside of the bottom board.

The bottom action area playing field is the grid into which a player inserts both red marked rectangular blocks 14 (FIG. 1) and symbol marked game blocks (FIG. 2). For this application, there are eight different symbol marked blocks which are illustrated with shapes. Additionally, these shapes are illustrated on a chart (FIG. 3). The chart shows individual players what they are aiming to discover in calling out spaces in turn. The length 17 of the chart measures a size of approximately between 0.1 and 50 inches, and the height 18 of the chart measures a size of approximately between 0.1 and 50 inches.

There are eight red marked 14 rectangular blocks, for a total of sixteen blocks, which go into the bottom action area playing field. However, the total number of rows, columns, and therefore coordinate spaces, may vary in an actual, commercially marketed product. This would naturally determine the total number of game blocks to be used in competition. For this application, there are four rows and four columns holding sixteen spaces within each grid.

The outer playing field (FIG. 6), the one visible to all other opponents, is congruent to the two inside playing fields with one exception. All playing fields are marked with alphanumeric symbols above or below and to the sides of each grid. This allows for appropriate coordinate identification during competition. All playing fields are identical in coordinate labeling, except that the alphanumeric symbols, in this case letters, are listed in reverse order above the outer playing field (compare FIG. 6 outer grid to FIG. 5 upper grid). This is so that each coordinate matches regardless of what view of the board is taken. This ensures that a called space by a player in fact matches, from the opposing player's perspective, the same coordinate. The sides of all grids are marked with numbers for this illustration. However, other renditions of the disclosed invention could use different types of identifiers in marking grid coordinates, such as characters above the grids, and colors on the sides.

During competition, as coordinates are selected, symbol marked and red marked rectangular blocks are shifted into out-of-play positions. This is done by taking the individual blocks from selected coordinates in the bottom action area playing field and inserting them into the spaces of the upper, vertical board. This has the result of pushing individual black 13 marked blocks through the upper board and ejecting them out the opposite side—the area visible to all opponents. An opponent exits competition when all his/her own symbol marked rectangular blocks have been discovered, as displayed in the outer playing field and matched with the appropriate chart.

Figure 5:
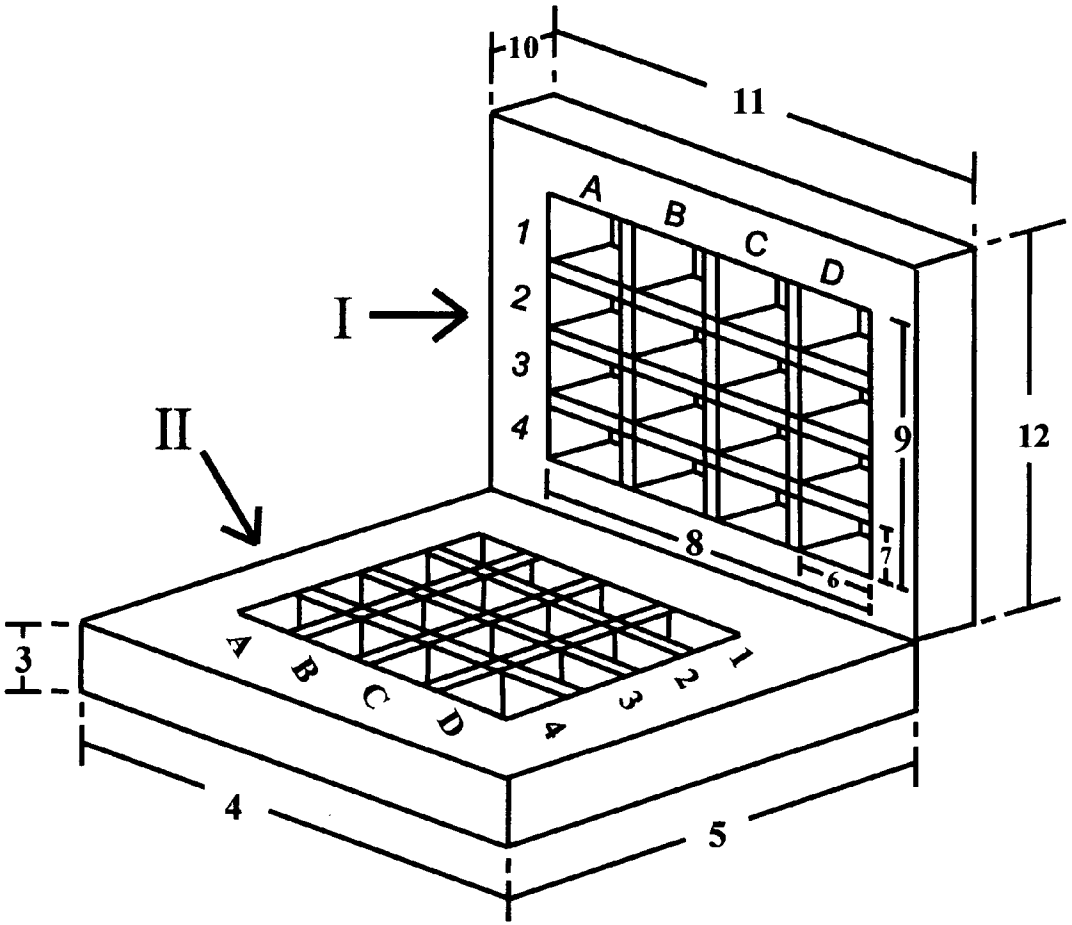
FIG. 5 represents the disclosed invention in an opened position from the perspective that would be observed by a single, particular player.
Figure 6:
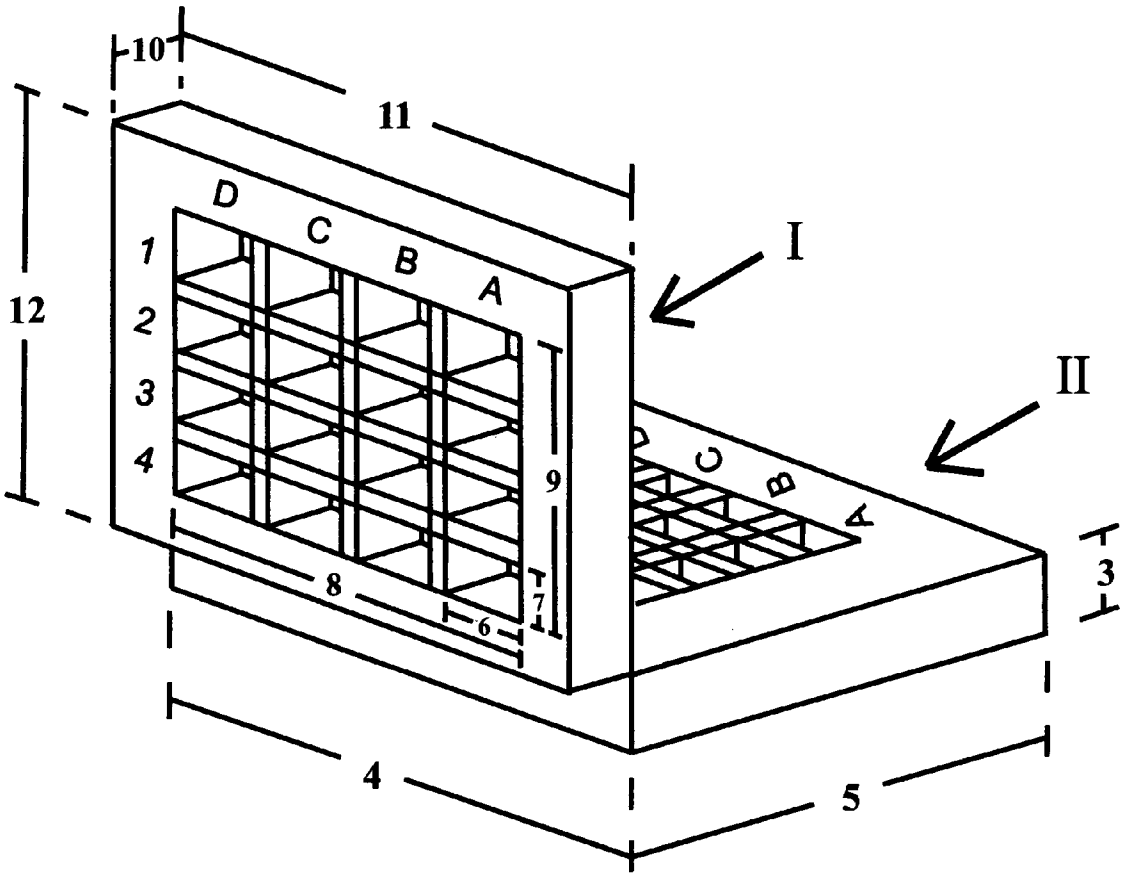
FIG. 6 represents the disclosed invention in an opened position from the perspective that would be observed by all other opponents during competition.
Figure 7:
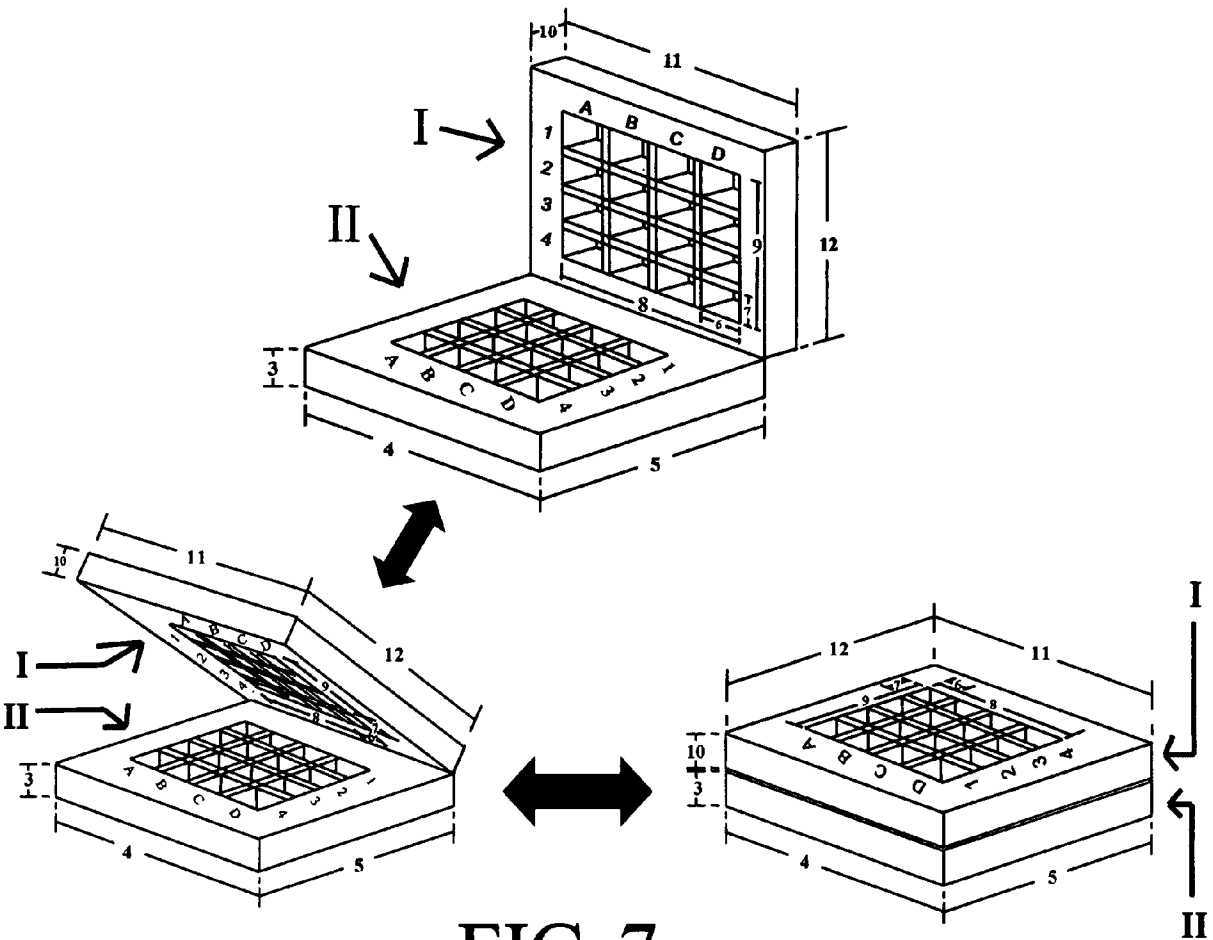
FIG. 7 demonstrates the closing and opening of the hinged game board for basic symbol recognition.

The length 6 of any given coordinate within a playing field measures a size of approximately between 0.1 and 50 inches (FIG. 5 and FIG. 6). The height 7 of any given coordinate within a playing field measures a size of approximately between 0.1 and 50 inches (FIG. 5 and FIG. 6). All four sides 1 of the rectangular blocks (FIG. 1 and FIG. 2),which would be both of the two sides of length and both of the two sides of height, are congruent, measuring a size of approximately between .1 and 50 inches on each side. The width 2 of the game blocks is a size measuring approximately between .1 and 50 inches (FIG. 1 and FIG. 2). The width of the blocks is a little greater than the width of either the bottom or upper, vertical game boards. The game blocks are of dimensions which fit within the dimensions of the individual coordinates on the bottom and upper, vertical boards. However, in between coordinate spaces there is some additional distance. In other words, there is no direct or near-direct contact between and among blocks when placed into the playing fields. This is so that young children may better manipulate the blocks in and out of spaces. Ample space between positioned blocks allows for ease of inserting and removing pieces into out of play positions. Hence, a child's dexterity is better facilitated in playing the game.

The length of the bottom board 4 and the length of the upper, vertical board 11 are congruent with a measure of approximately between 0.1 and 50 inches (FIG. 5 and FIG. 6). The height of the bottom board 5 and the height of the upper, vertical board 12 are congruent with a measure of approximately between 0.1 and 50 inches (FIG. 5 and FIG. 6). The width of the bottom board 3 and the width of the upper, vertical board 10 are congruent with a size measuring approximately between 0.1 and 50 inches (FIG. 5 and FIG. 6).

It is important to note, again, that the width measurements of the bottom and the upper, vertical boards do not exceed the width of any of the rectangular game blocks. In other words, the rectangular game blocks partially stick out of the playing field grid coordinates. Please note, also, that a flat panel III is attached to the underside of the bottom board. This prevents the game blocks from falling through the game apparatus, should it be lifted up for any reason.

For purposes of discussion in this application, this disclosure will illustrate a short round of play between two participants—player A and Player B. Keep in mind that that there may be more than two players in competition, with each player utilizing a separate game board.

Figure 8:
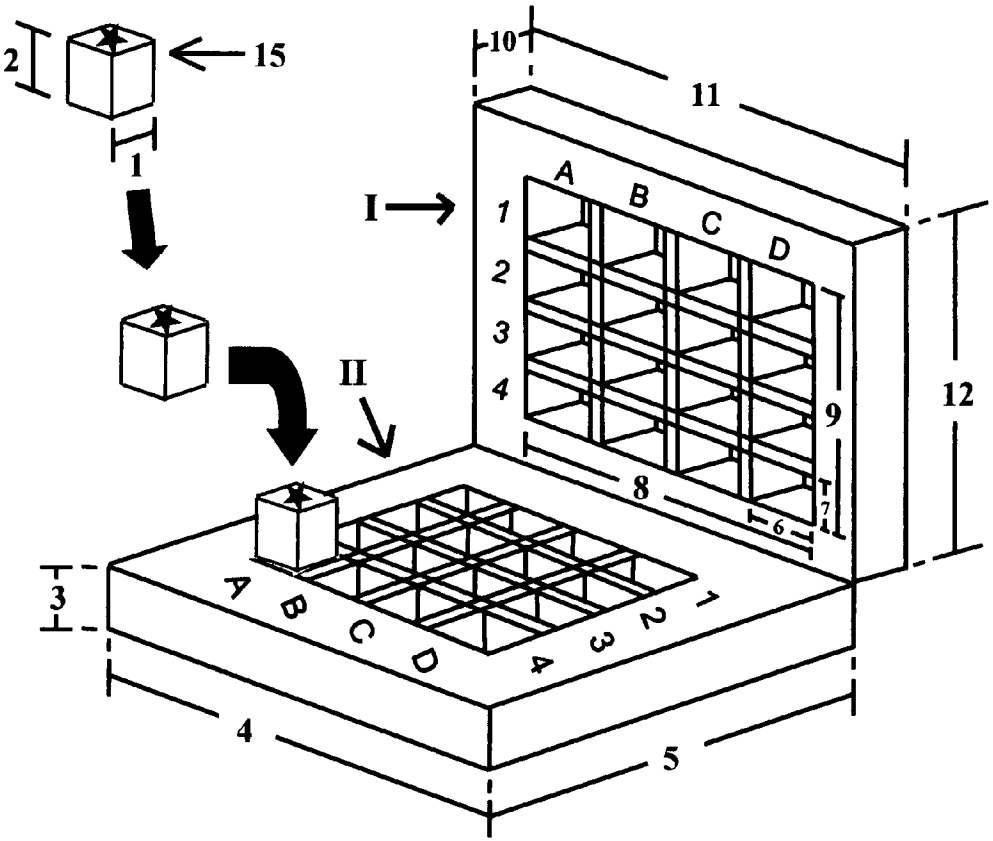
FIG. 8 demonstrates the insertion of a rectangular game block imprinted with a star 15 into the A4 coordinate of a bottom action area playing field.
Figure 9:
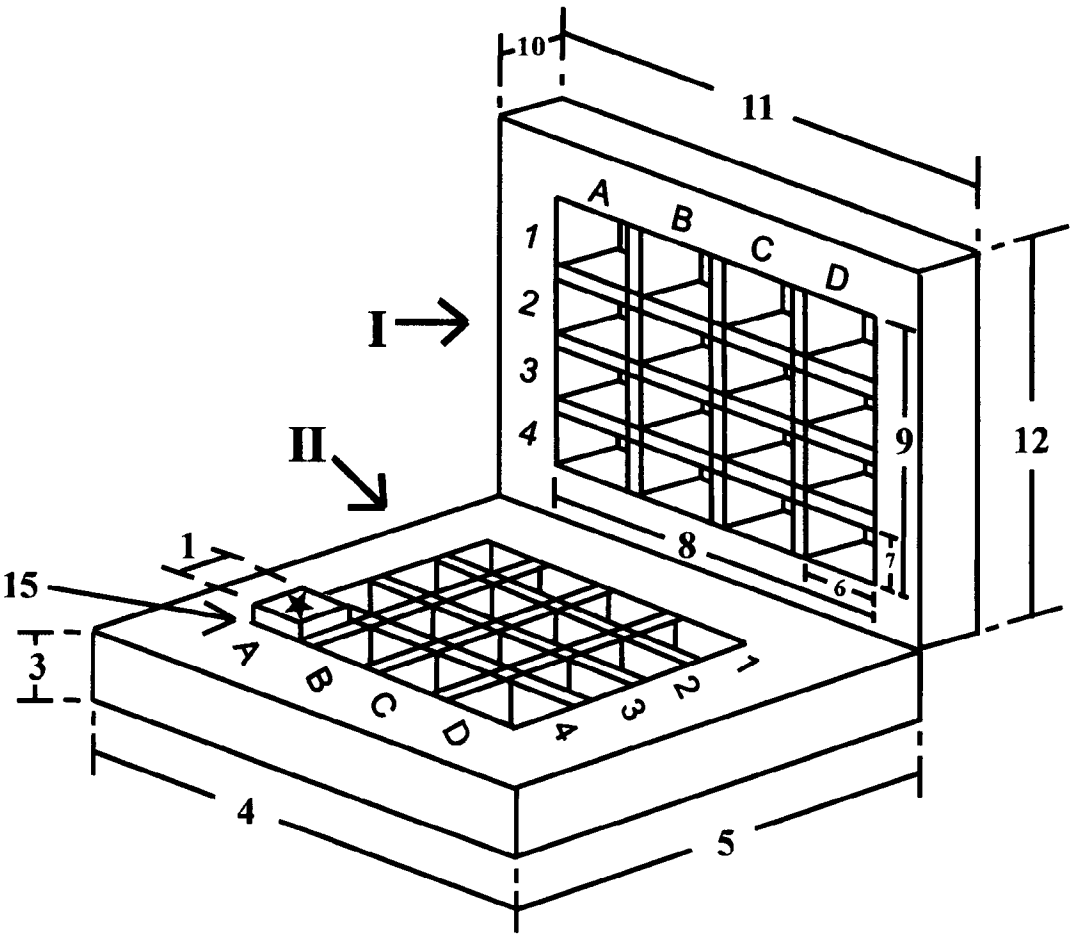
FIG. 9 demonstrates the full placement of a rectangular game block 15 into the A4 coordinate of the bottom action area playing field.

Starting with Player B, a star marked rectangular block 15 is placed into the A4 coordinate of the bottom action area playing field (FIG. 8). This is the region that opponents target during competition. FIG. 9 shows the star block 15 fully inserted into the A4 coordinate, partially sticking out due to the underside panel preventing it from falling through the board.

Figure 10:
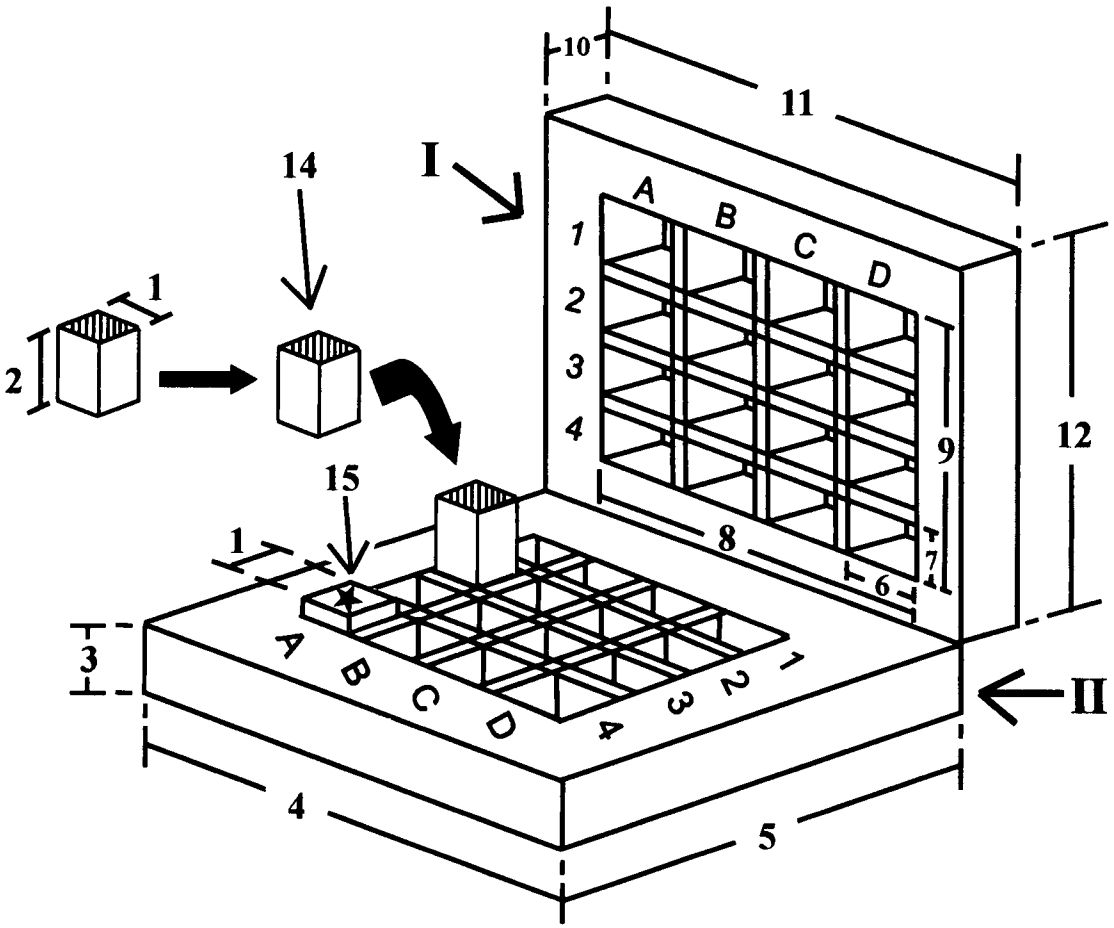
FIG. 10 demonstrates a red rectangular game block 14 being inserted into the A2 coordinate of the bottom action area playing field of a game board.
Figure 11:
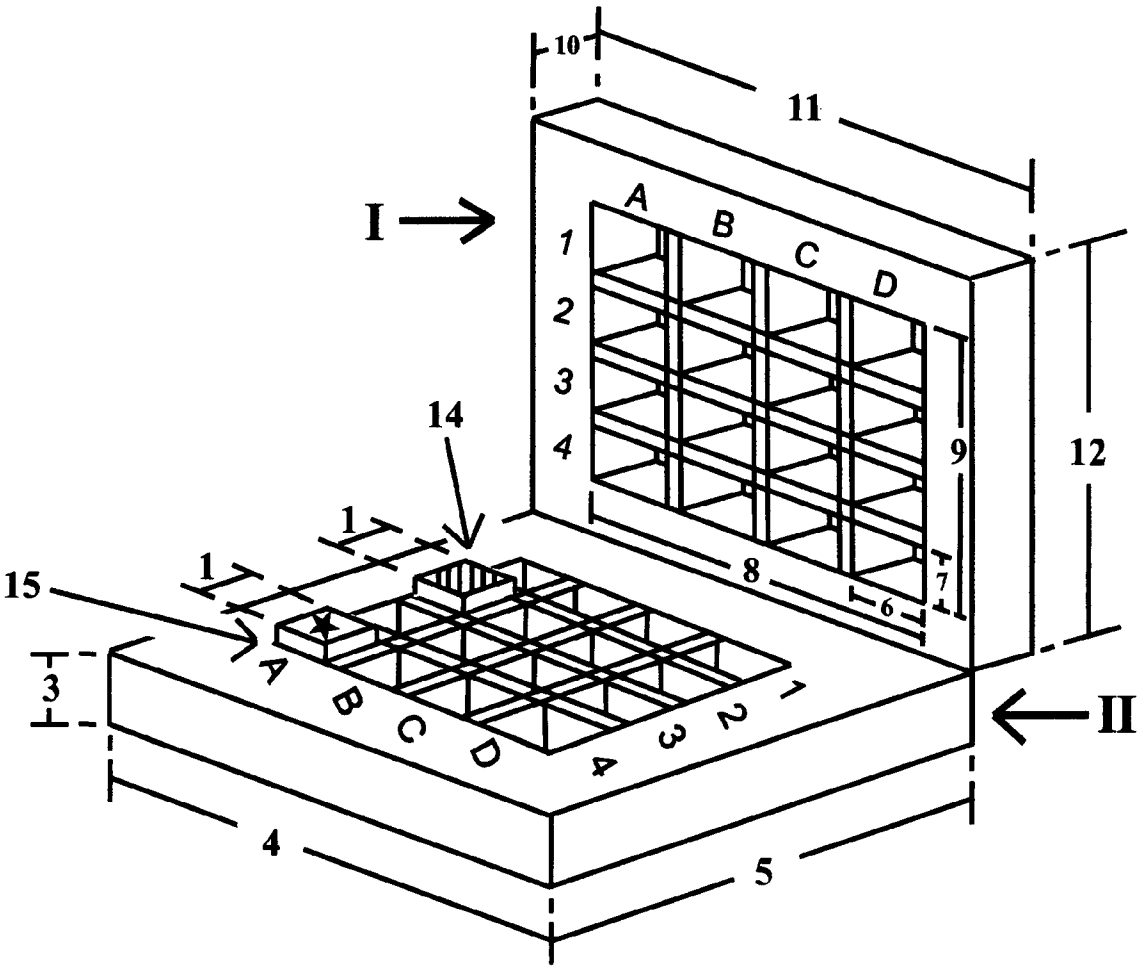
FIG. 11 illustrates the full placement of a red rectangular game block 14 into the A2 coordinate of the bottom action area playing field of a game board.
Figure 12:
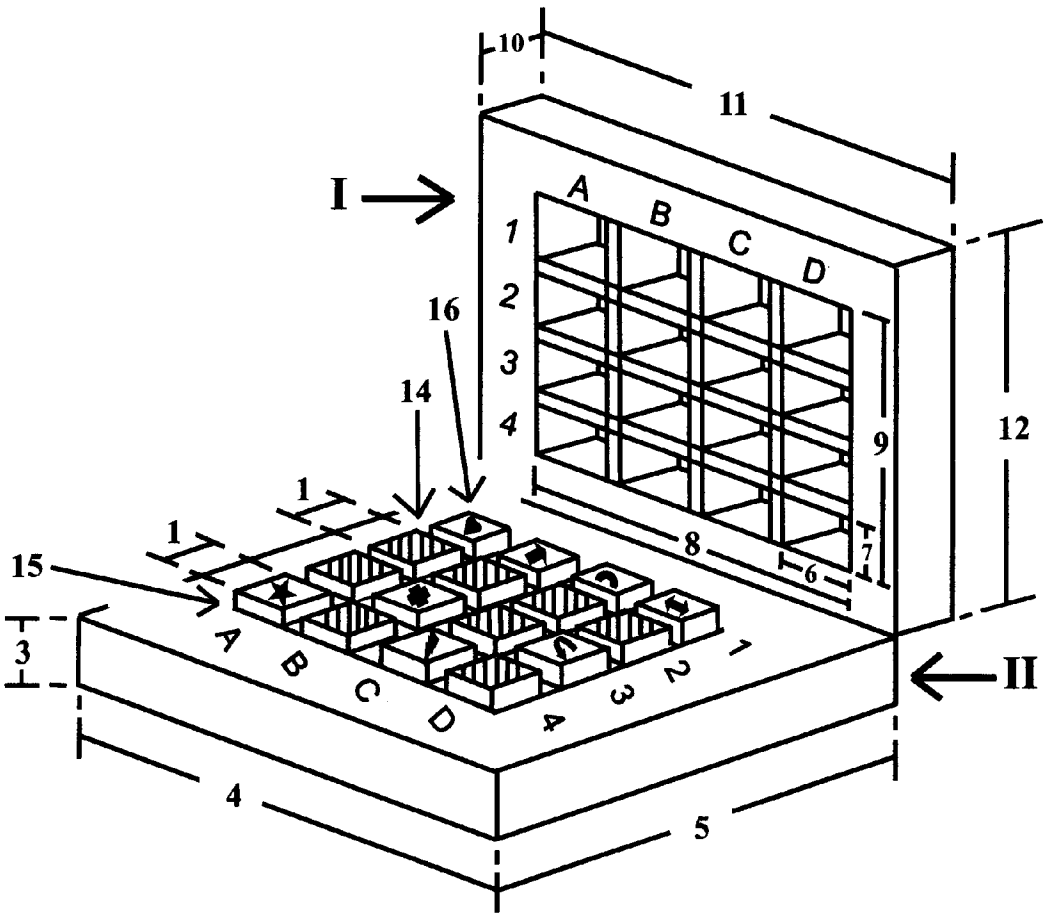
FIG. 12 shows all sockets in the bottom action area playing field of a game board filled with rectangular game blocks, these being red 14 game pieces and game pieces marked with shapes.

FIG. 10 demonstrates a red block 14 being inserted into the A2 coordinate of Player B's bottom action area playing field. FIG. 11 shows the red block 14 fully inserted into the A2 coordinate. FIG. 12 shows the entire bottom action area playing field of player B filled with game blocks (eight red 14 and eight blocks imprinted with shapes).

Figure 13:
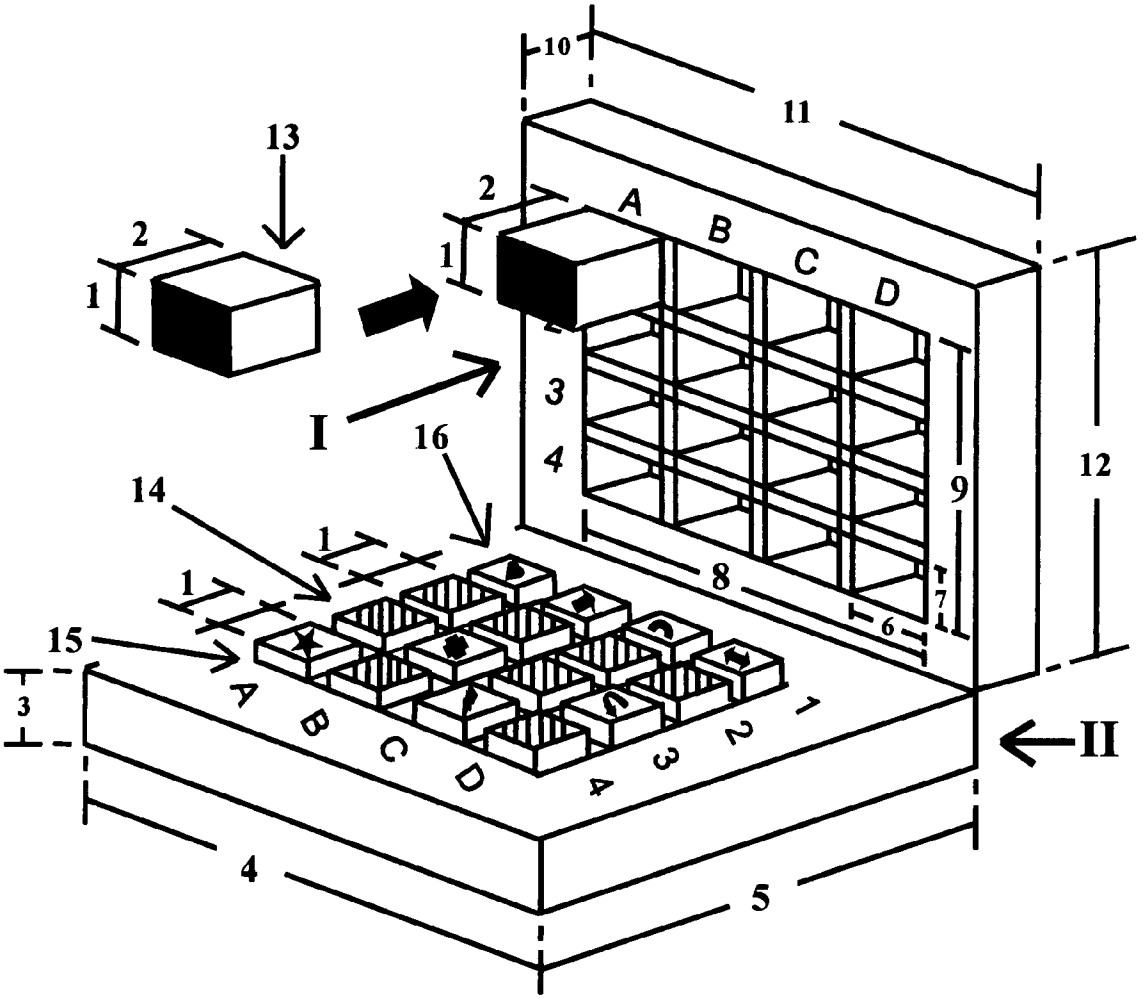
FIG. 13 demonstrates a black rectangular game block 13 being inserted into the A1 coordinate of the upper, vertical playing field of a game board.
Figure 14:
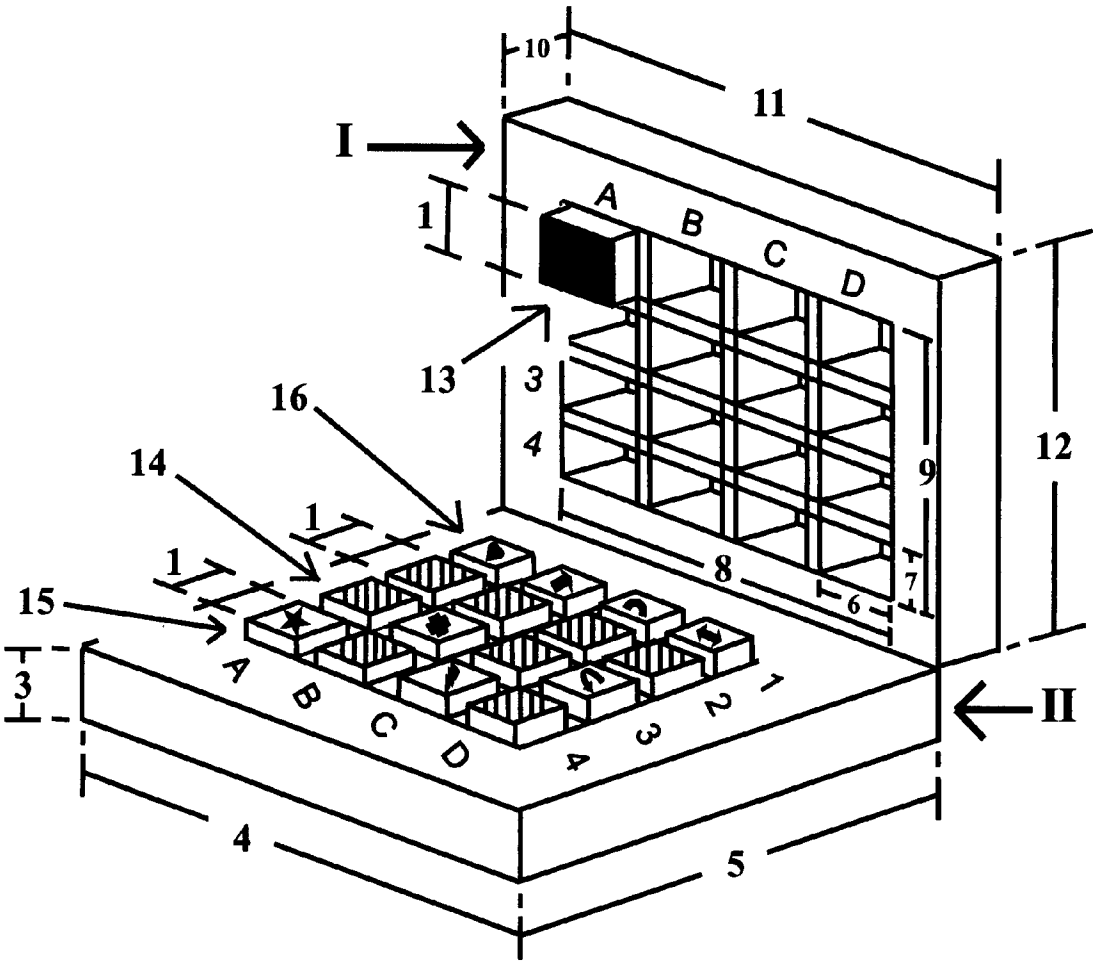
FIG. 14 shows the full insertion of a black rectangular game block 13 into the A1 coordinate of the upper, vertical playing field of an upper game board.
Figure 15:
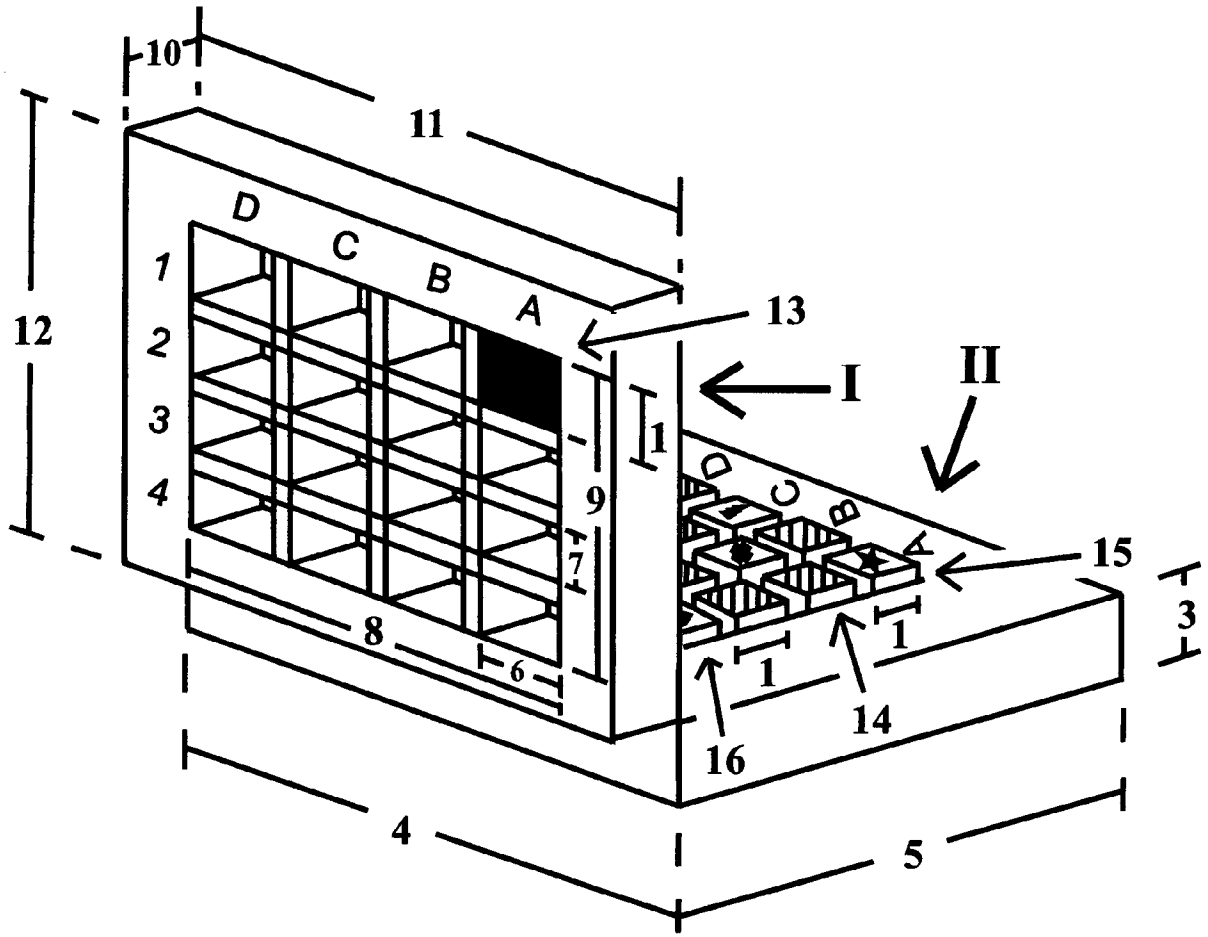
FIG. 15 illustrates the reverse view of the game board where only the front would be visible to all other opponents, and where a black rectangular game block 13 is in the A1 coordinate of the outer grid playing field.

FIG. 13 demonstrates a black rectangular block 13 being inserted into the A1 coordinate of the upper, vertical playing field. FIG. 14 shows that same block fully inserted into the A1 coordinate, and FIG. 15 shows the reverse view of the game board from the perspective that other opponents would see. For ease of illustration, the rectangular blocks viewed from the perspective of all other opponents shows them appearing flat against the grid in the outer playing fields. In actuality, these blocks would appear partially sticking out of the outer grid, with some unevenness.

Figure 16:
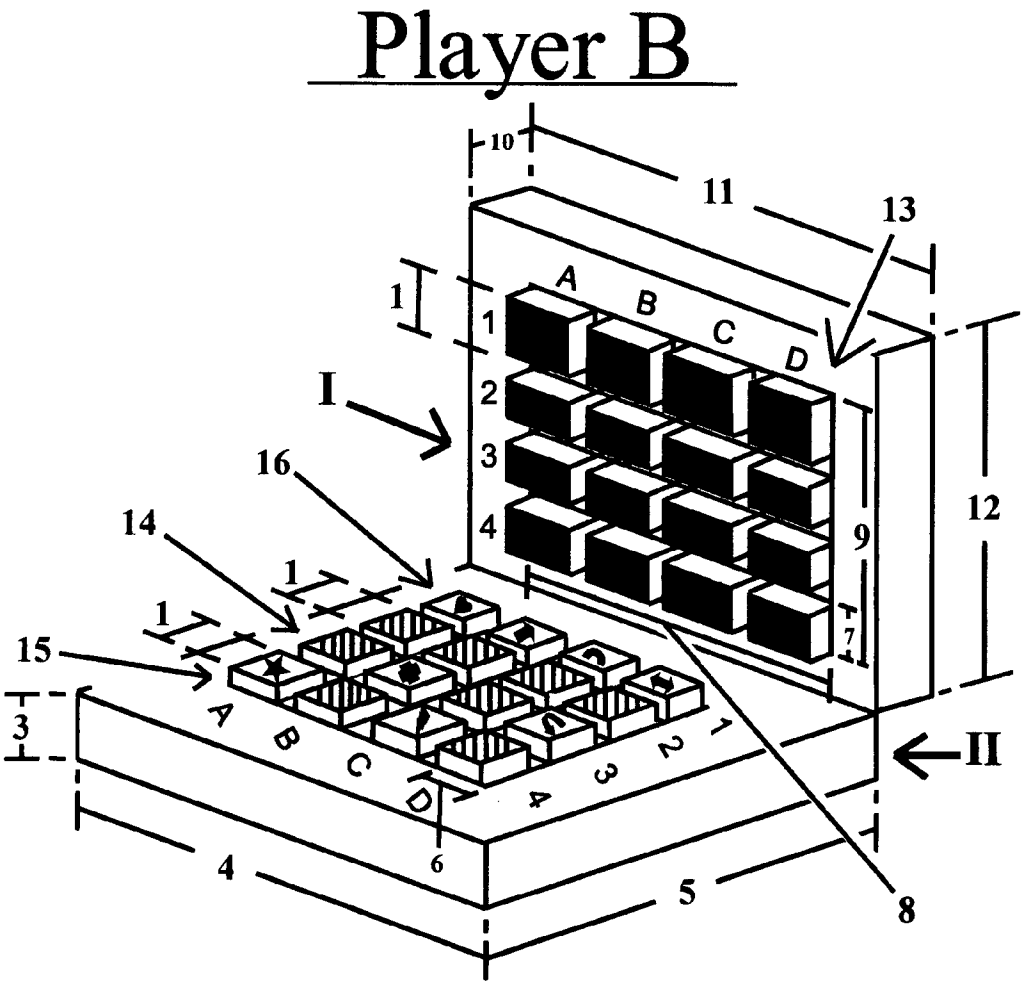
FIG. 16 presents the game board where all spaces are filled with the appropriate pieces, where the upper, vertical game board holds black rectangular blocks 13, and the bottom action area playing field holds red blocks 14 and blocks marked with shapes, so that this game board is now ready for play and will represent player B in this application.

FIG. 16 shows player B's entire game board filled with the appropriate blocks in each coordinate—red 14 and symbol marked blocks in the bottom, and black marked blocks 13 in the top.

Figure 17:
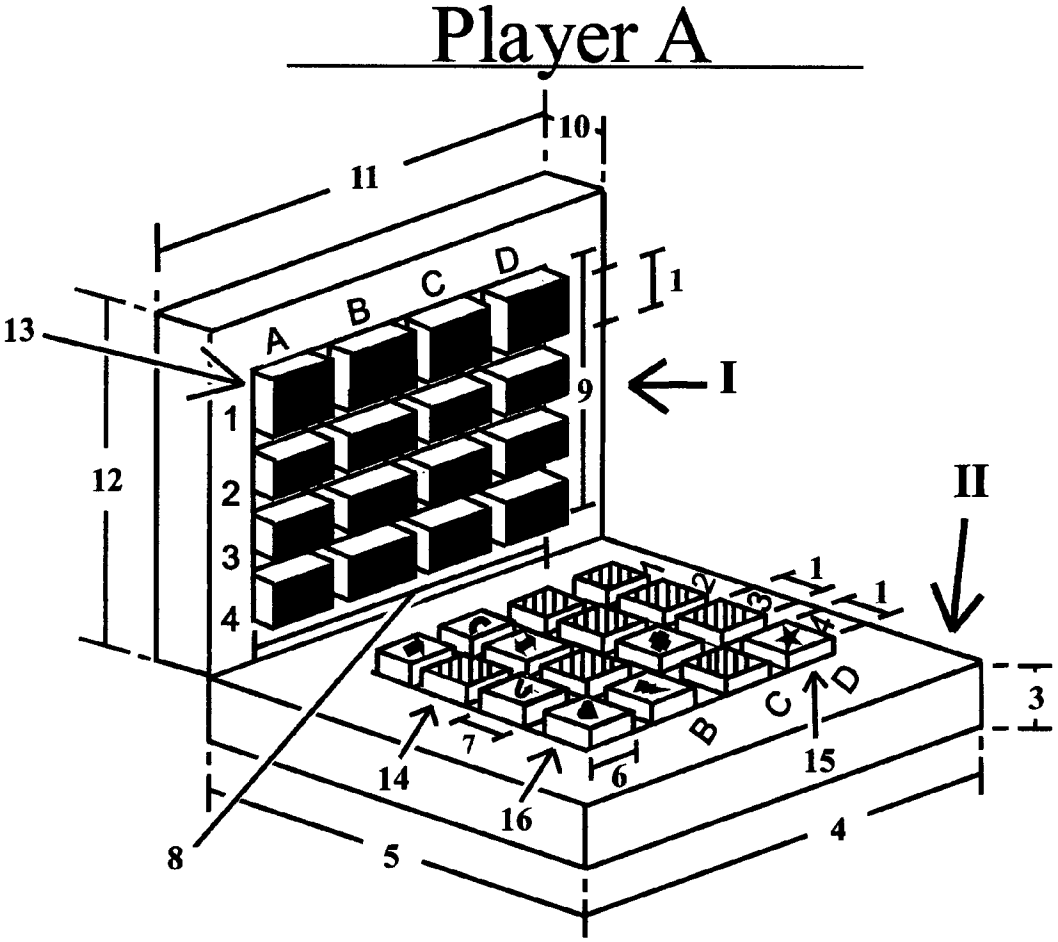
FIG. 17 presents player A where all spaces are filled with appropriate placement of game blocks.

FIG. 17 shows the arrangement of rectangular blocks on player A's grids.

Figure 18:
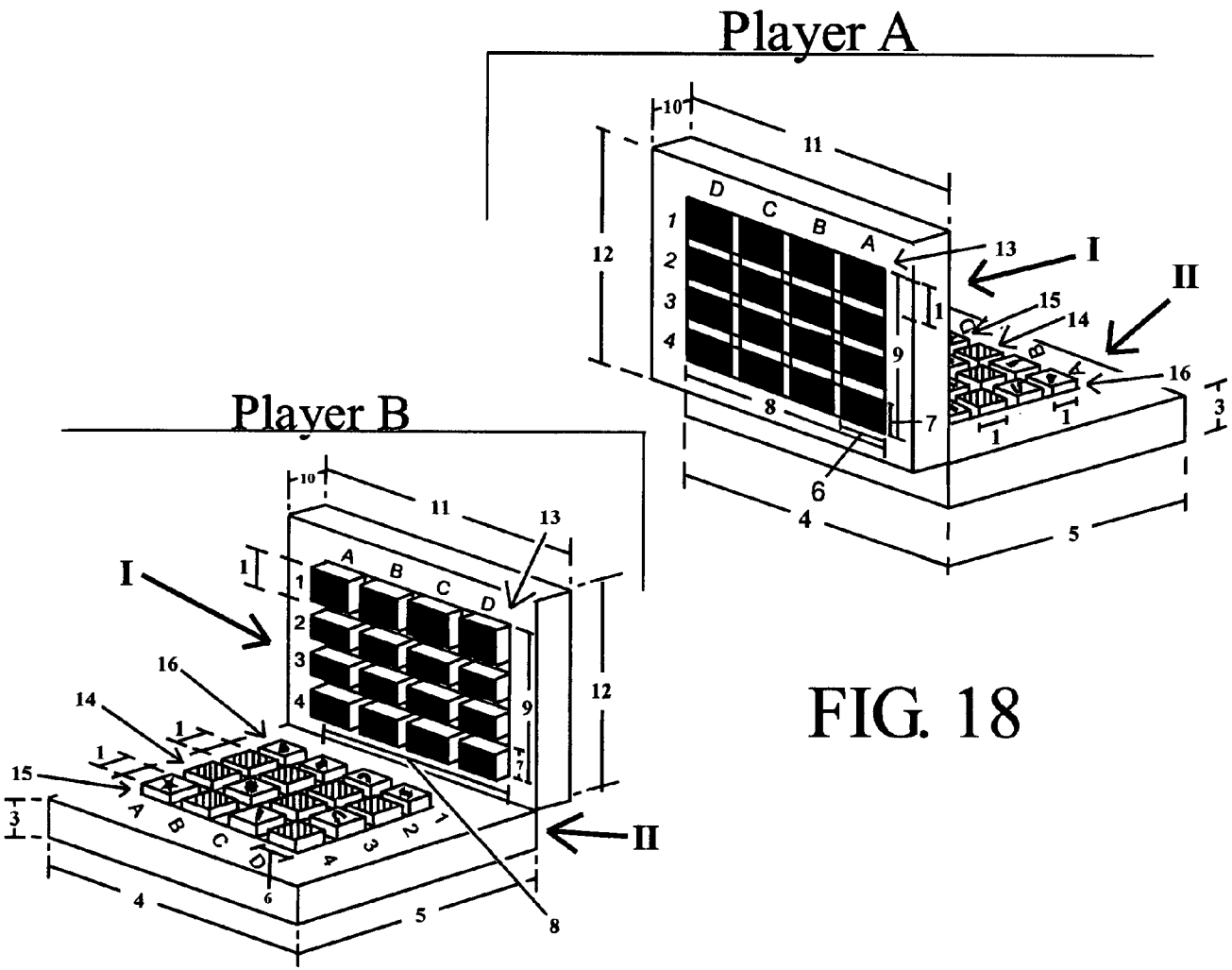
FIG. 18 presents Player A and Player B angled opposite from each other as would be the case in near-actual play.

FIG. 18 shows how the two opponents would arrange their game boards in near-actual play. During the explanation, this disclosure will show first player B's game board as Player A calls out coordinates. As spaces are selected, the disclosure will illustrate the effect that has on the opponent's board, until players reverse, at which point this discussion will move to player A and show how player B's calling out of spaces affects player A's game board.

Figure 19:
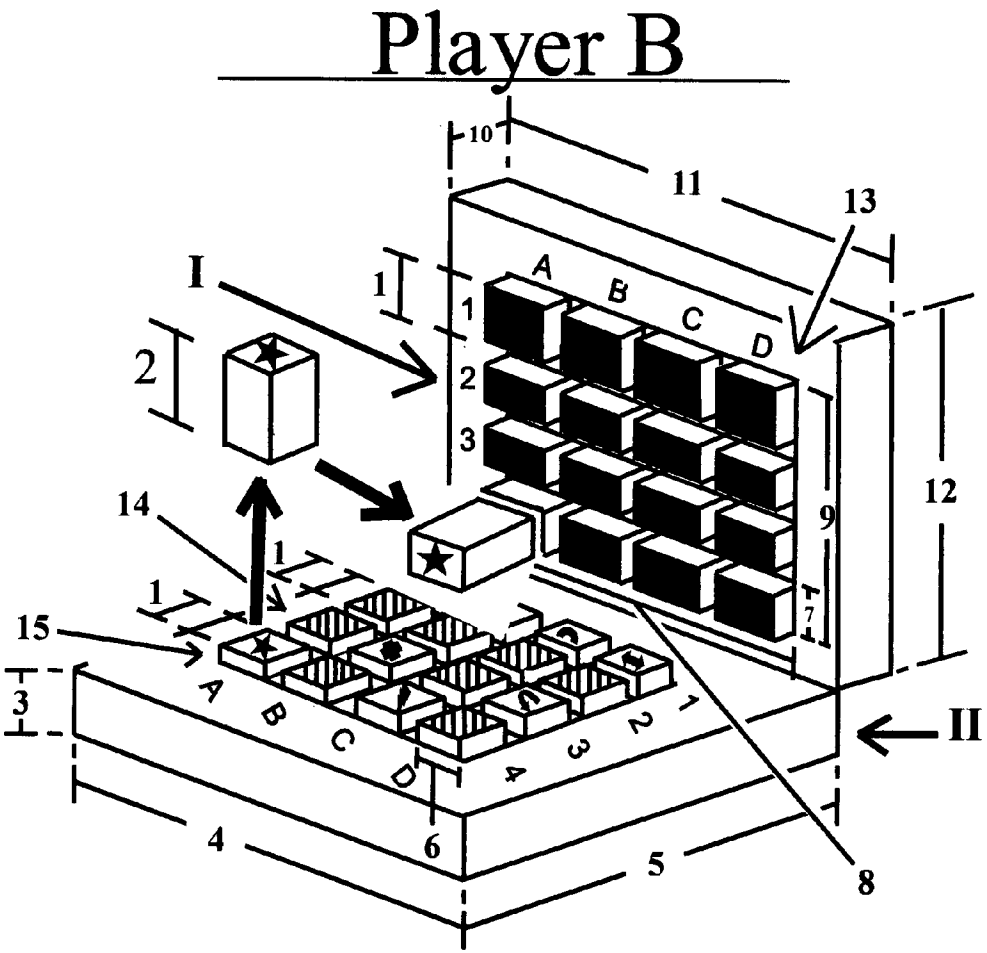
FIG. 19 through FIG. 24 demonstrate a round of moves between Player A and Player B, with FIG. 20 illustrating a side-cut of the game board where a block is being inserted into the top vertical board, which in turn pushes the prepositioned piece out the opposite side.
Figure 20:
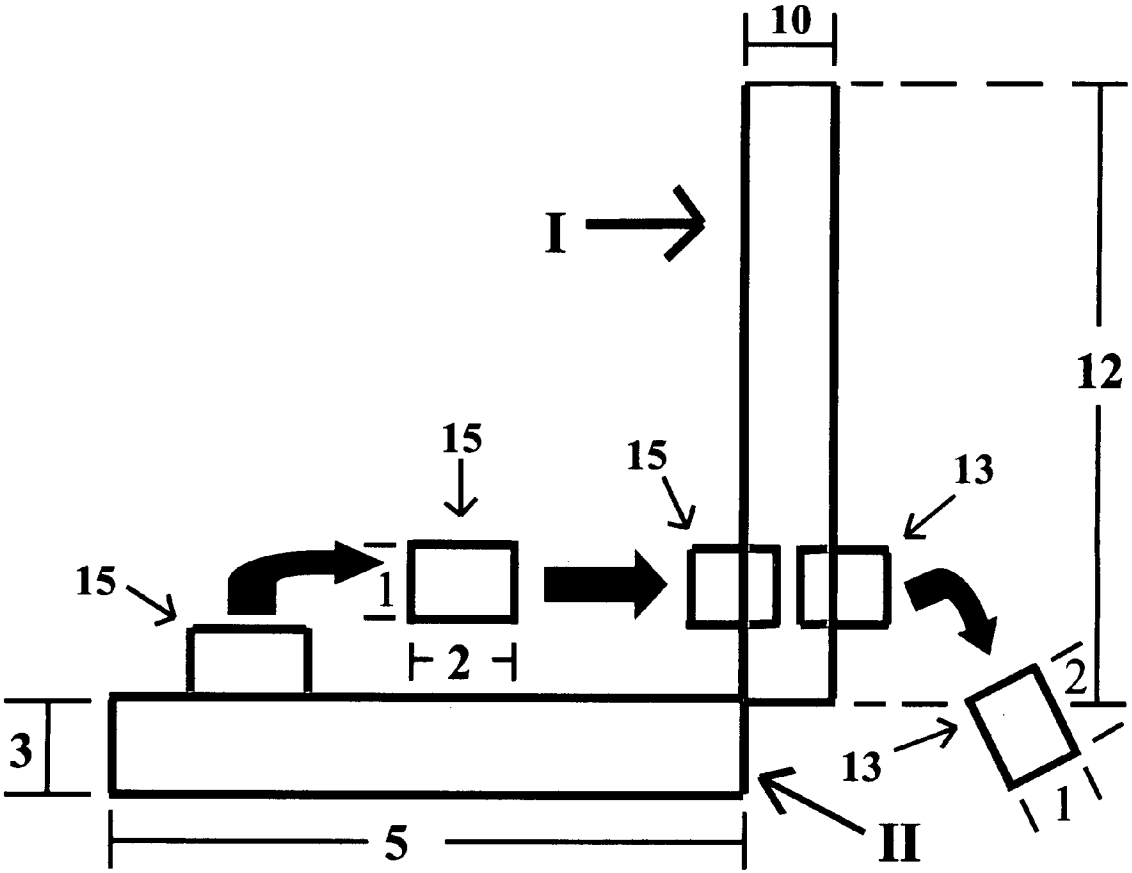
Figure 21:
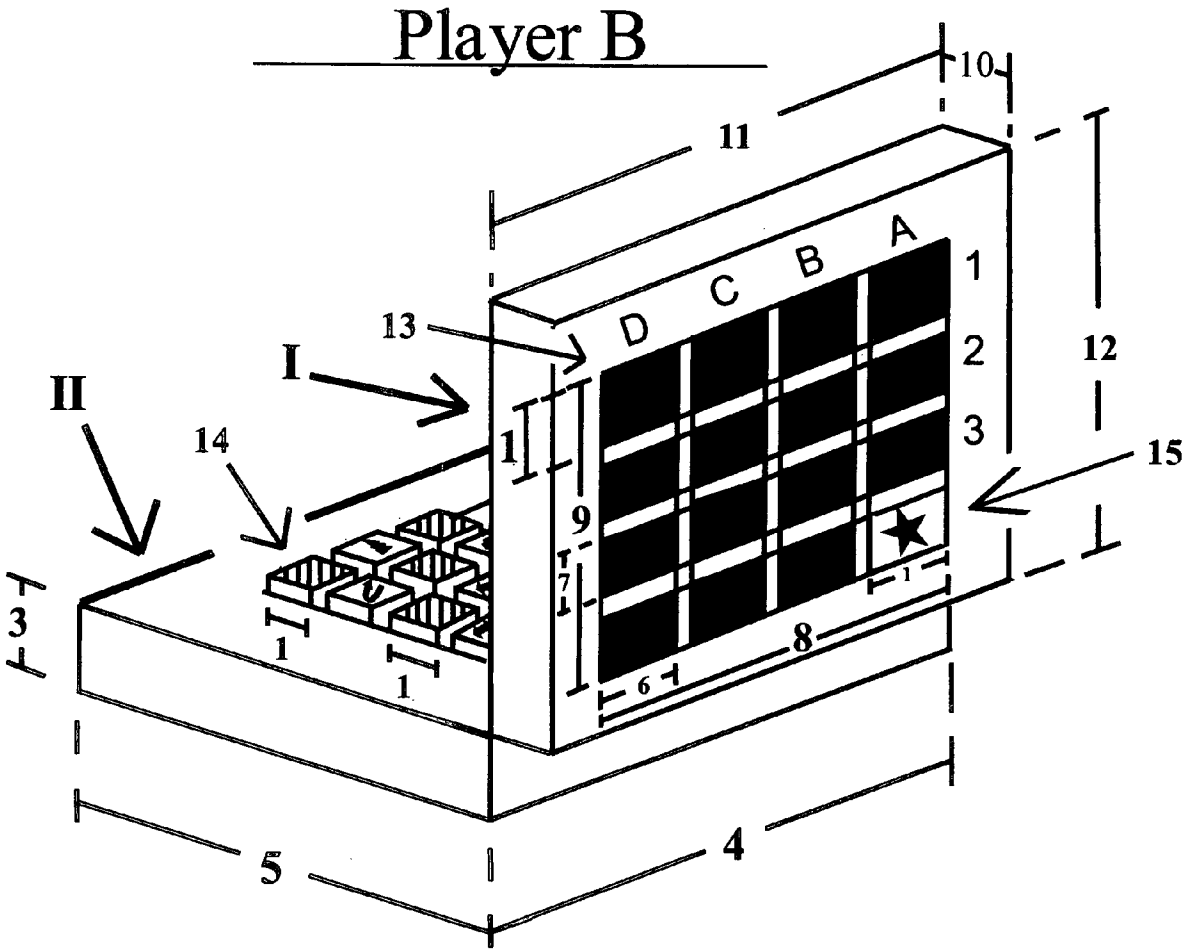

The first move starts with player A. He/she calls the space A4. This result has player B remove the rectangular block out of the A4 coordinate (FIG. 19). It so happens that the coordinate is indeed occupied by a symbol marked game piece—a block imprinted with a star 15. Player B proceeds to insert this block into the A4 coordinate of his/her upper, vertical playing field (FIG. 19). In the process of pushing the game block into the upper grid coordinate, the prepositioned black marked block 13 is ejected out of the upper, vertical playing field, and through to the opposite side of the game board. FIG. 20 shows this action from a side-cut view of the game board. The opposing player now sees that the space he/she called indeed had a symbol marked block (FIG. 21). Therefore, player A may call another space from Player B's grid.

Figure 22:
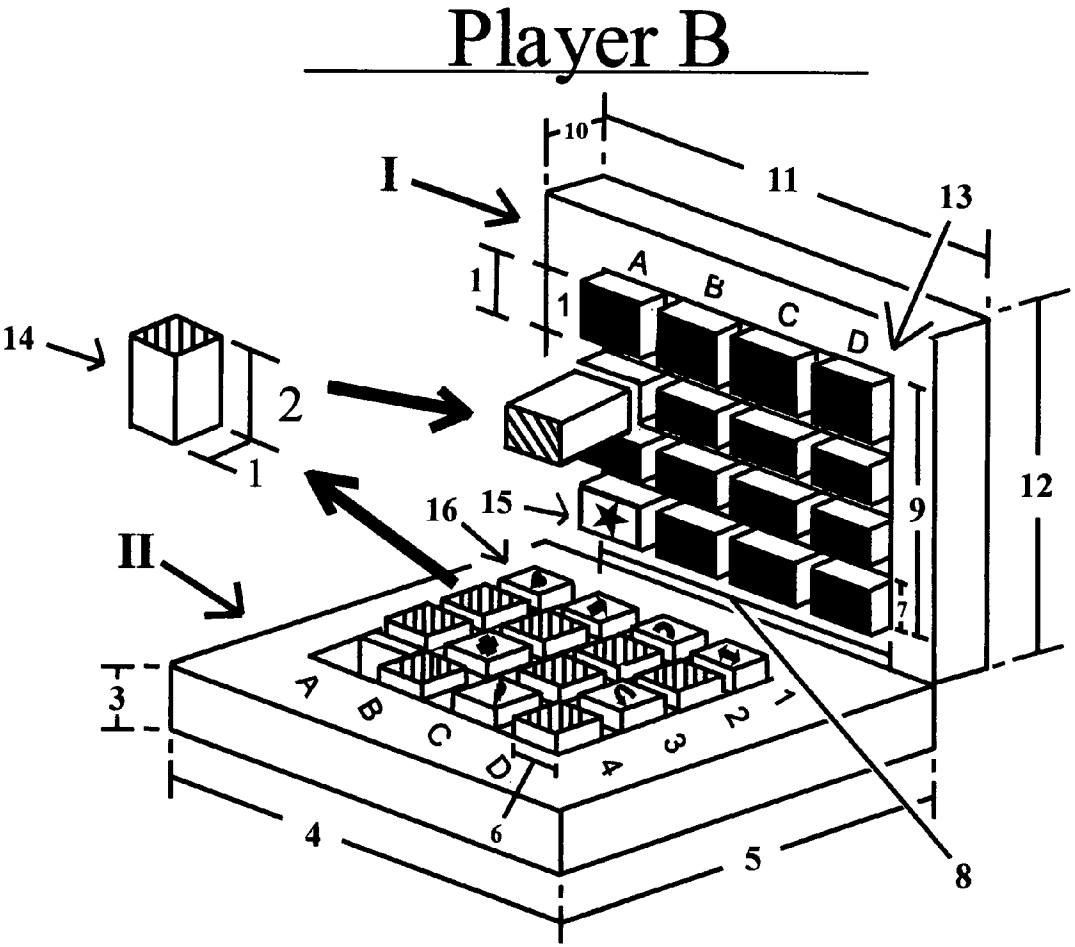
Figure 23:
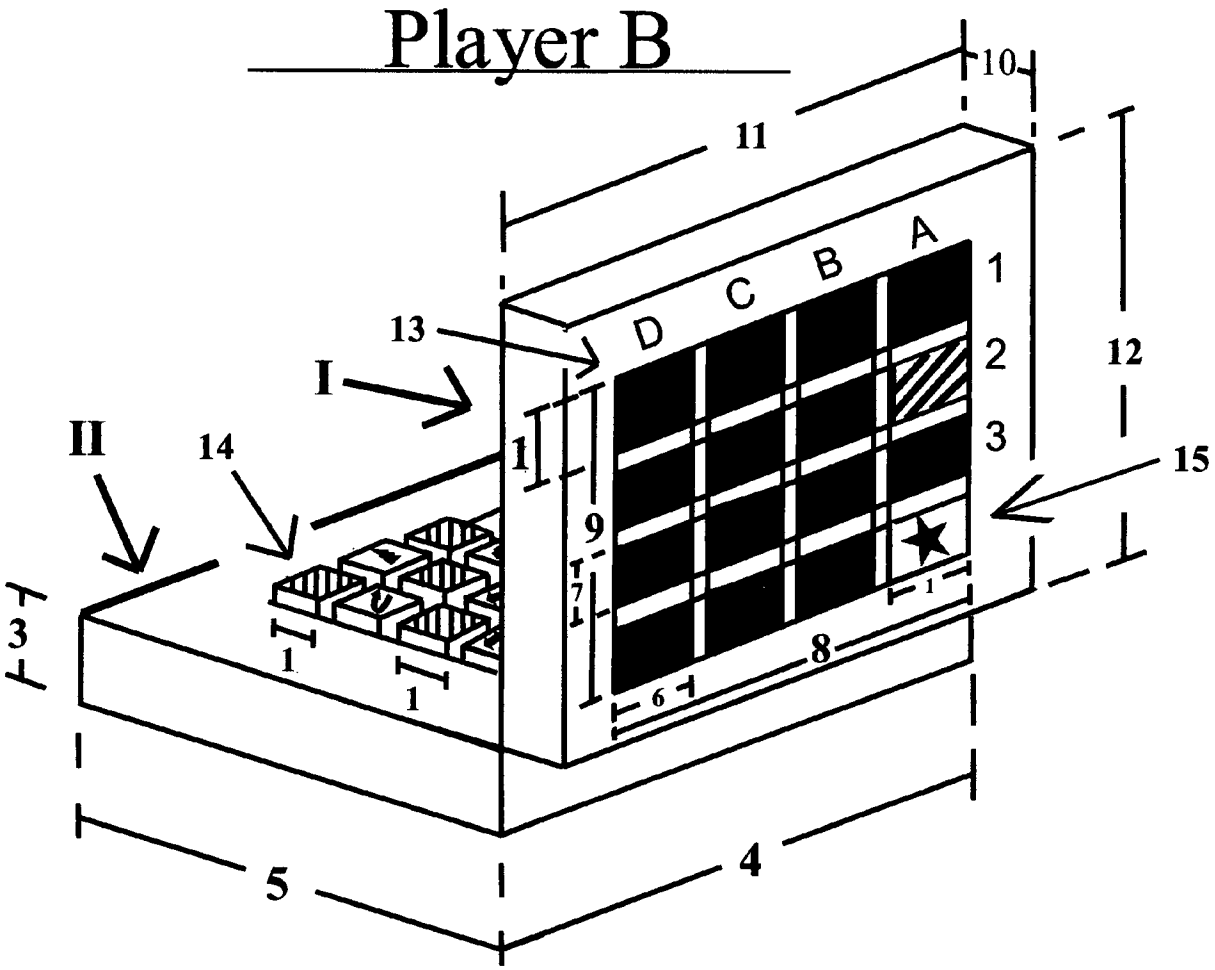

This time, Player A selects the A 2 coordinate (FIG. 22). Player B takes the block from that space and inserts it into the corresponding space on his/her upper, vertical board. The space chosen in fact holds no symbol marked block. The red marked block 14 is fully inserted into the A2 space, and this indicates to Player A that his/her turn is over (FIG. 23).

Figure 24:
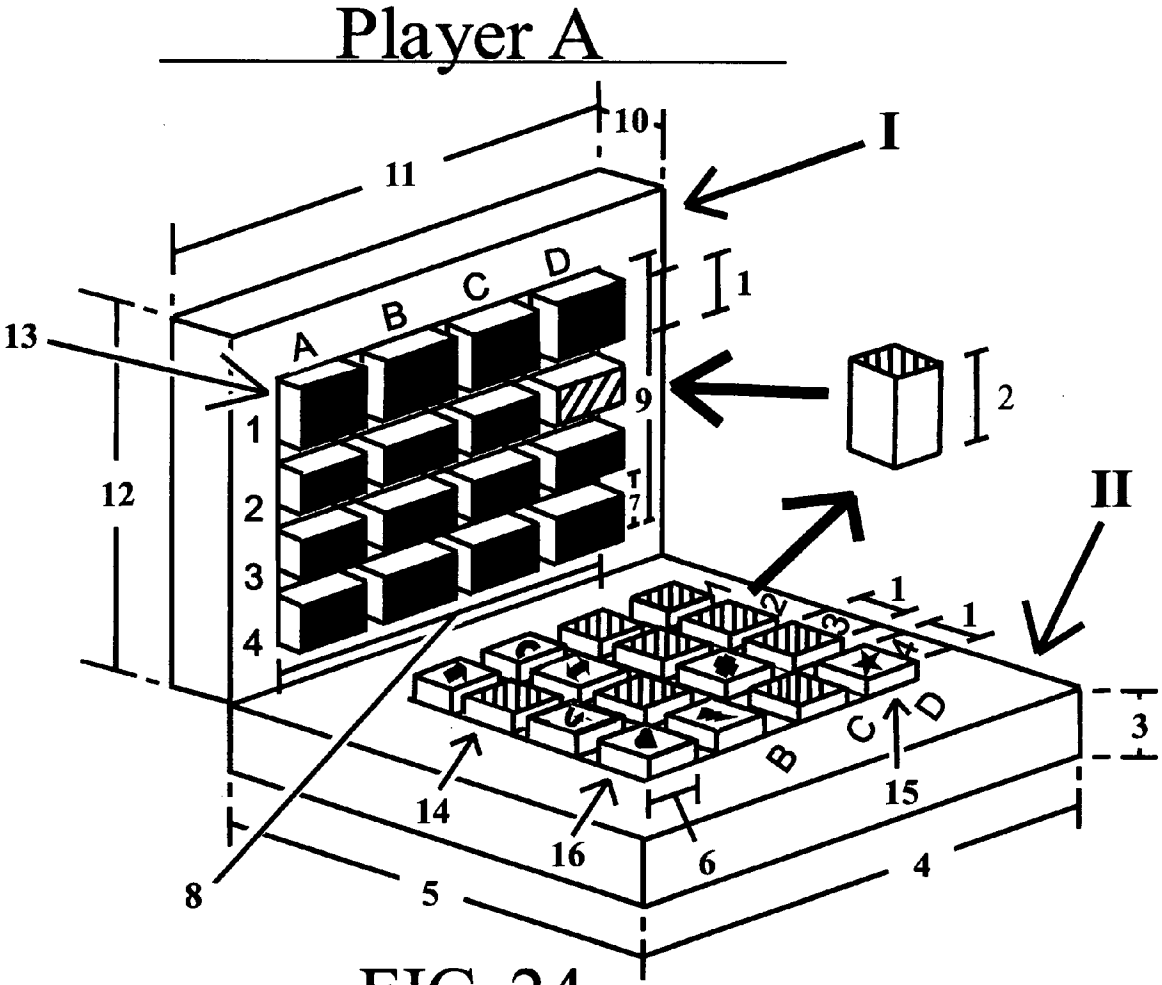

Player B selects the D2 space, which in fact has no symbol marked block. Player A takes the red marked block 14 from the D2 coordinate on his/her bottom action area playing field and pushes it into the corresponding space on his/her upper grid (FIG. 24). The first round of play is completed, and this game of take away would continue until one of the players successfully calls out and discovers all the symbols from an opponent's bottom action area playing field.

Figure 25:
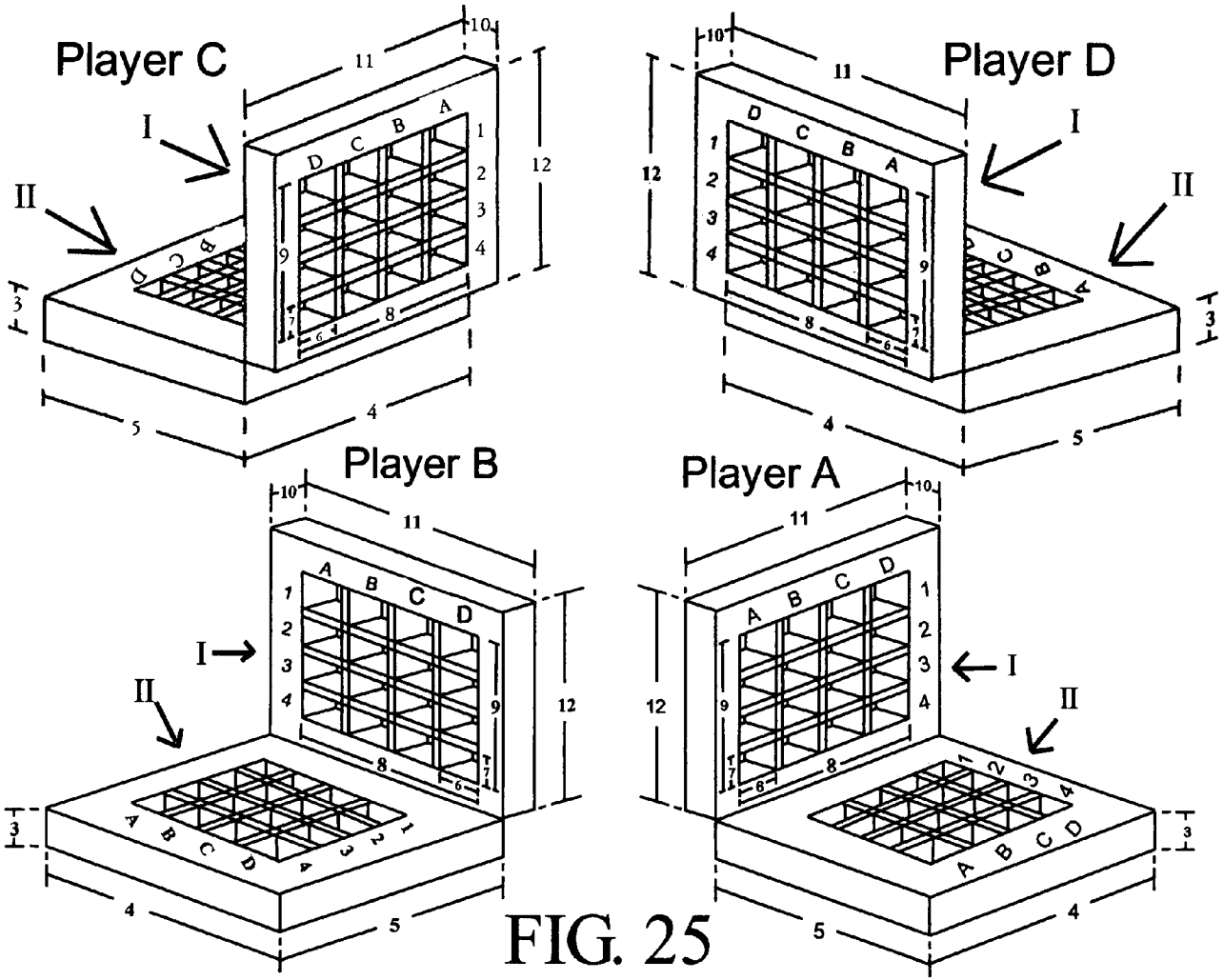
FIG. 25 illustrates the application of the present invention with four game boards arranged for opponent play.

FIG. 25 shows the placement of four closable—type game boards in opposition to one another in preparation of play. In theory, there is no limit as to how many players could compete.

Figure 26:
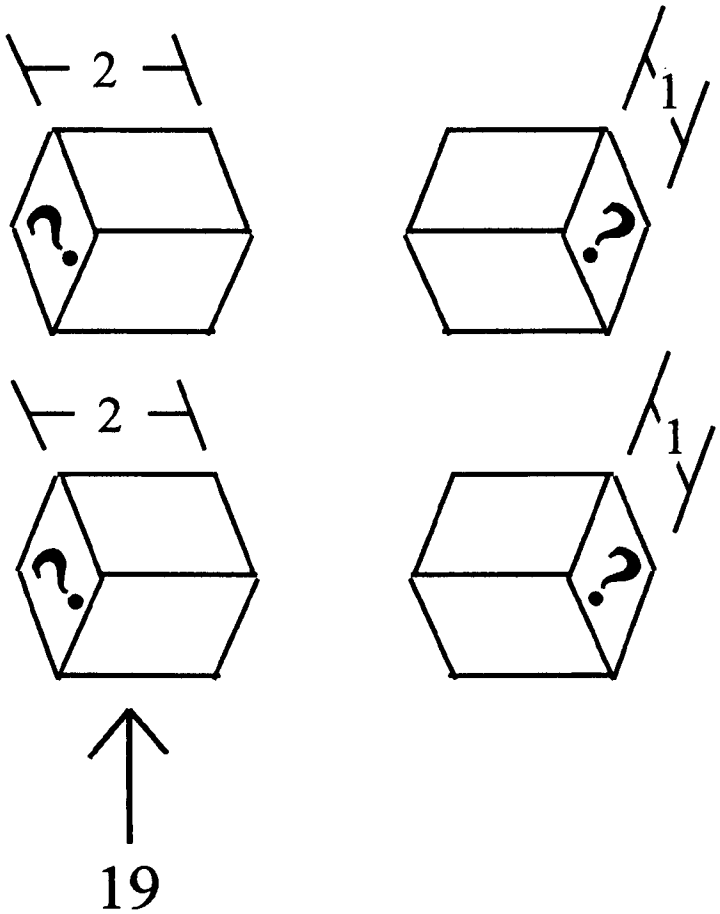
FIG. 26 represents a set of rectangular blocks, optional for use as game pieces during competition, which are imprinted with a question mark on either end and which are identified in this disclosure with a number 19 for the purpose of reference in this application.

This disclosure has thus far presented a game which may be played by four year old children. An additional embodiment of the invention allows the game apparatus to be more directly tailored for six year old children. The simple addition of rectangular game blocks 19 imprinted with a question mark at either end accomplishes this (FIG. 26).

Figure 27:
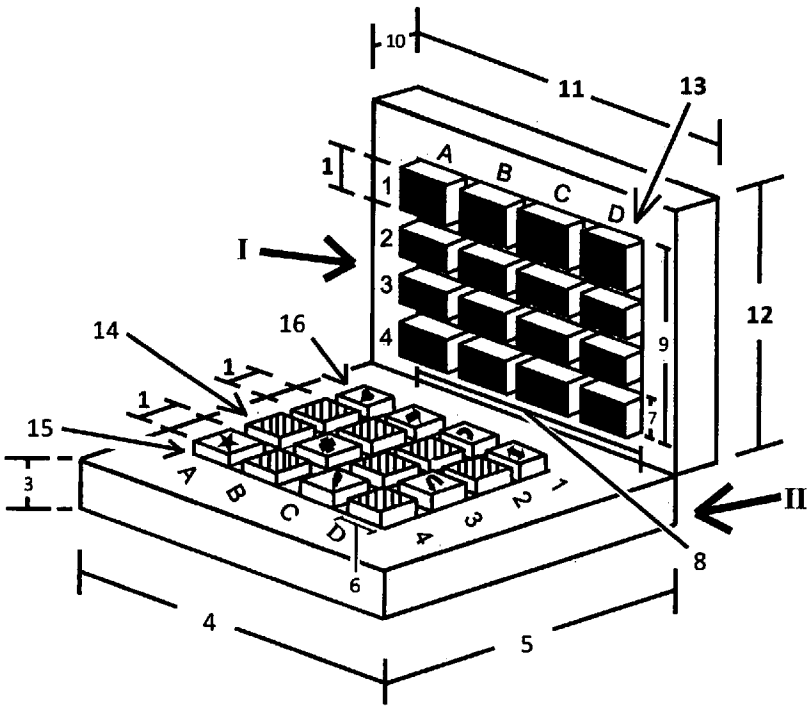
FIG. 27 illustrates a player's game board, in this case the player being identified as Player B, with all game pieces arranged appropriately for game start.
Figure 28:
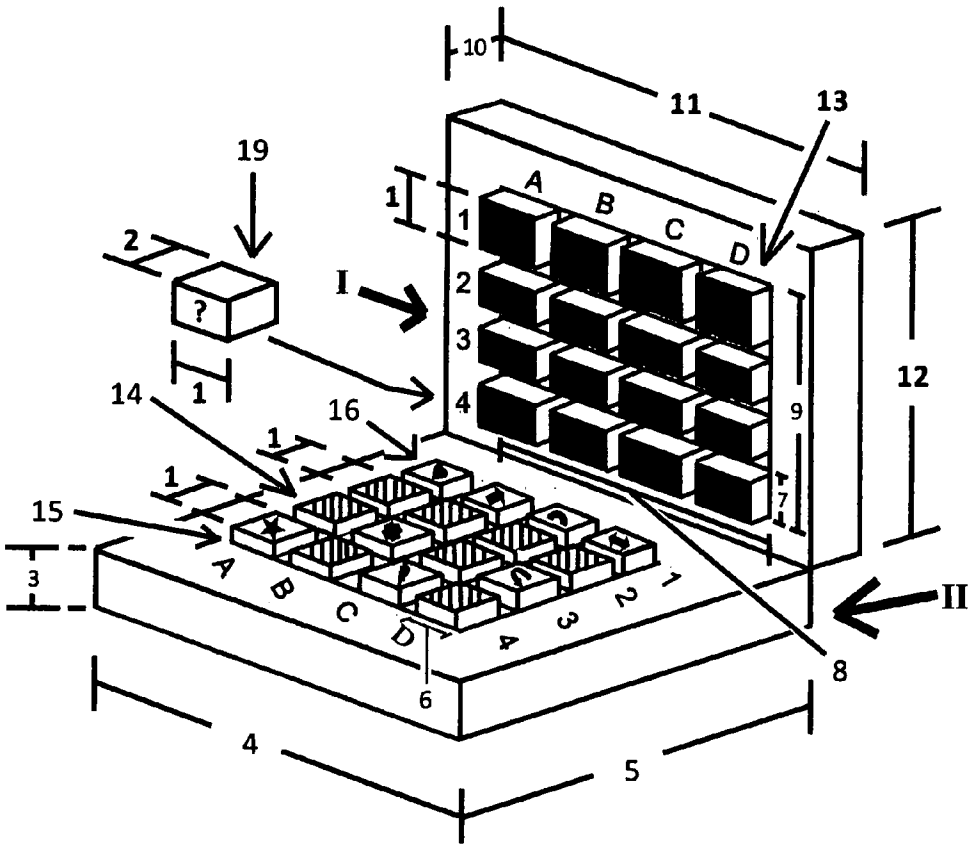
FIG. 28 shows where a question marked game piece 19 would go upon an opponent choosing the A4 space, a coordinate which in fact holds an identity-unknown game piece.
Figure 29:
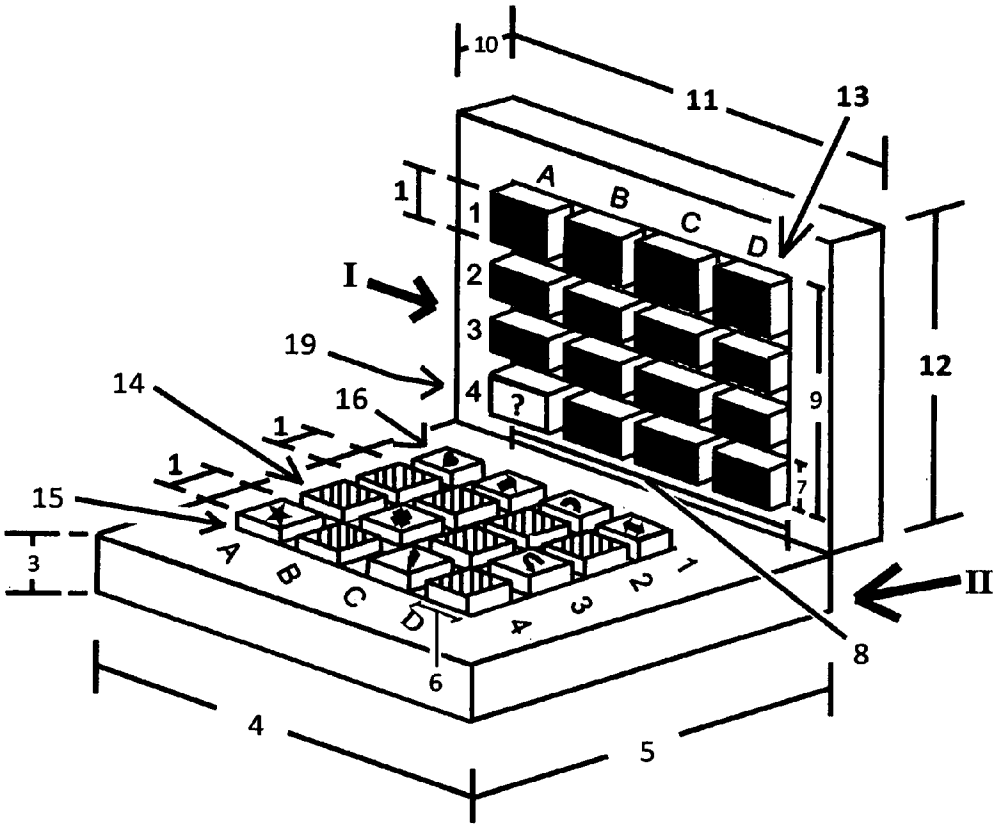
FIG. 29 shows the question marked game piece 19 fully inserted into the A4 space of the upper, vertical grid as would be seen from the perspective of Player B.

Upon the appropriate arrangement of all game elements for game start, Player B awaits the opposing player's coordinate selection (FIG.27). The opponent in turn chooses A4, whereupon Player B takes a question marked 19 game block (FIG. 28) and fully inserts that element into the A4 coordinate in his/her upper, vertical playing field (FIG. 29).

Figure 30:
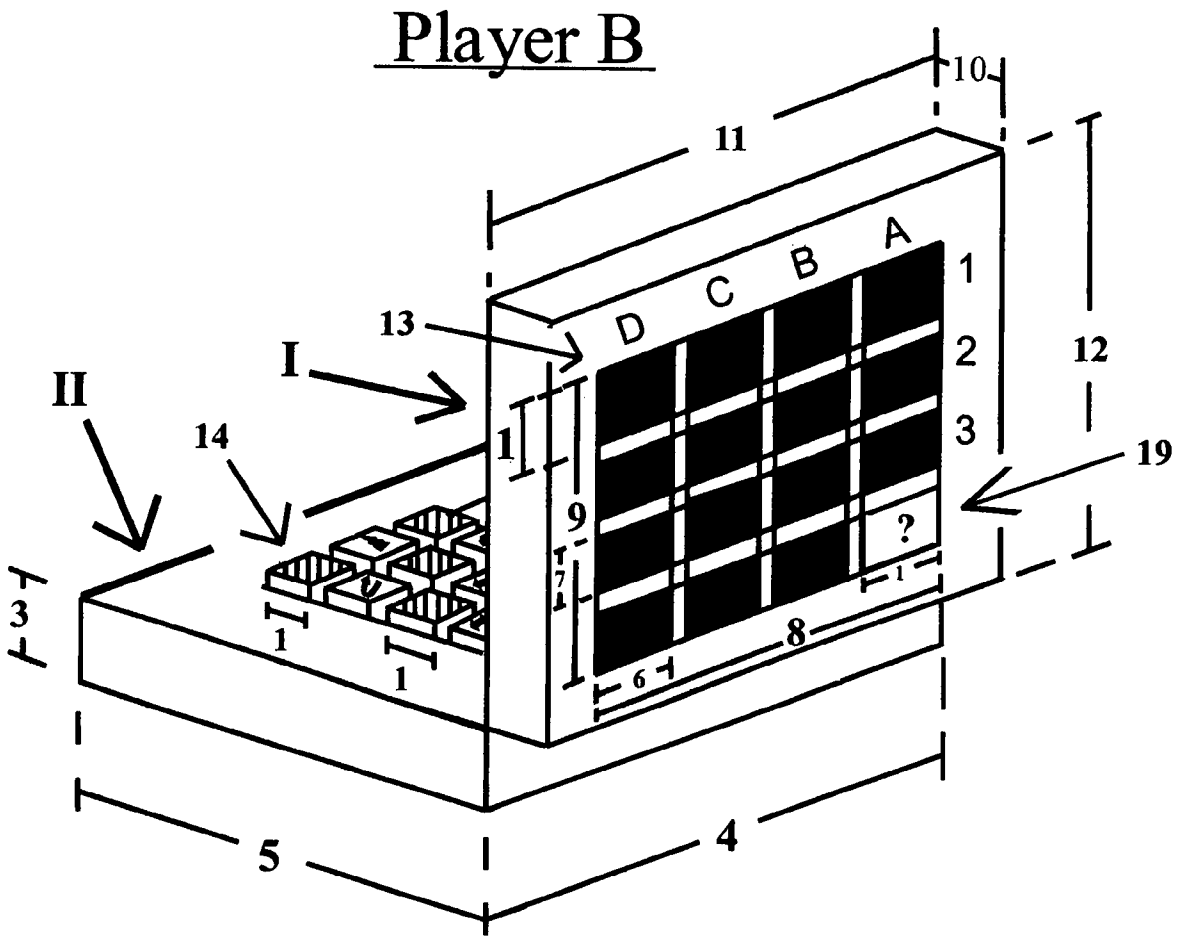
FIG. 30 shows the Player B game board with the question marked game piece 19 fully inserted into the-A4 space of the upper, vertical grid from the reverse perspective that would be seen by all other opponents.
Figure 31:
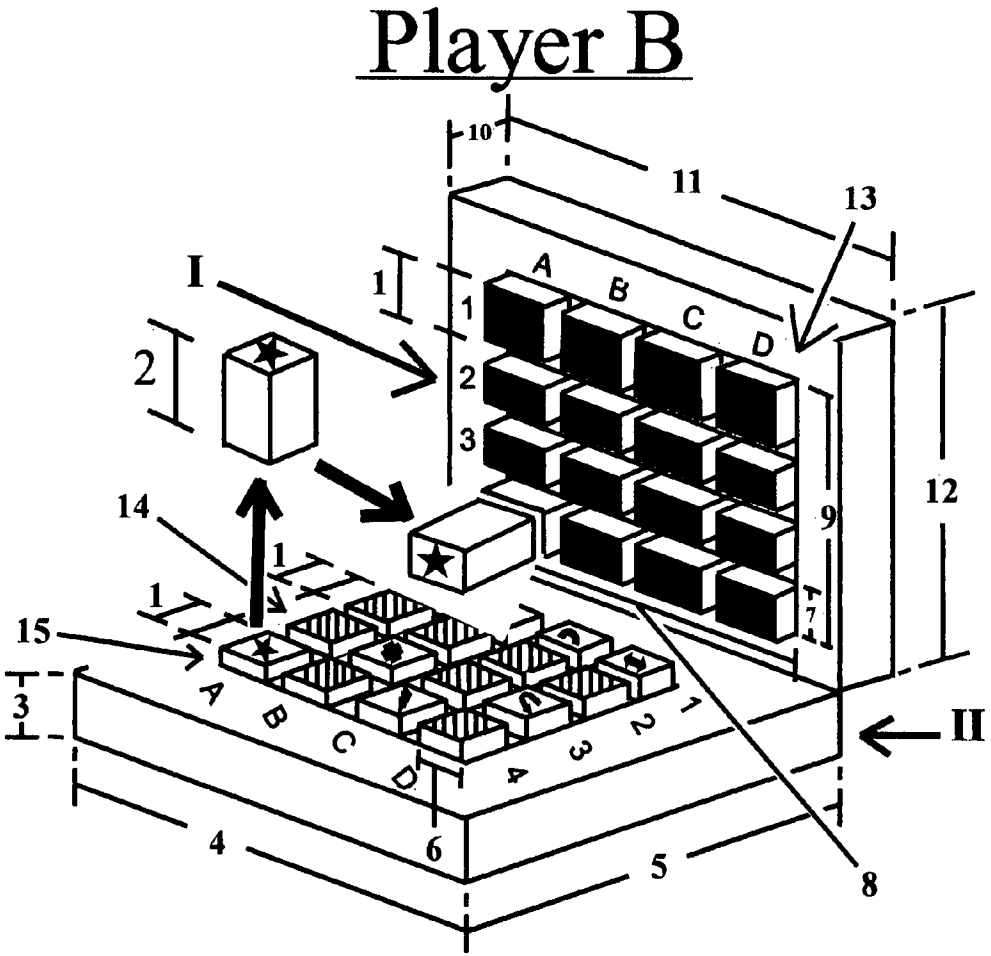
FIG. 31 shows the star marked game piece 15 being removed out of the A4 space of the Player B bottom action area playing field and being inserted into the corresponding coordinate of his/her upper, vertical playing field.
Figure 32:
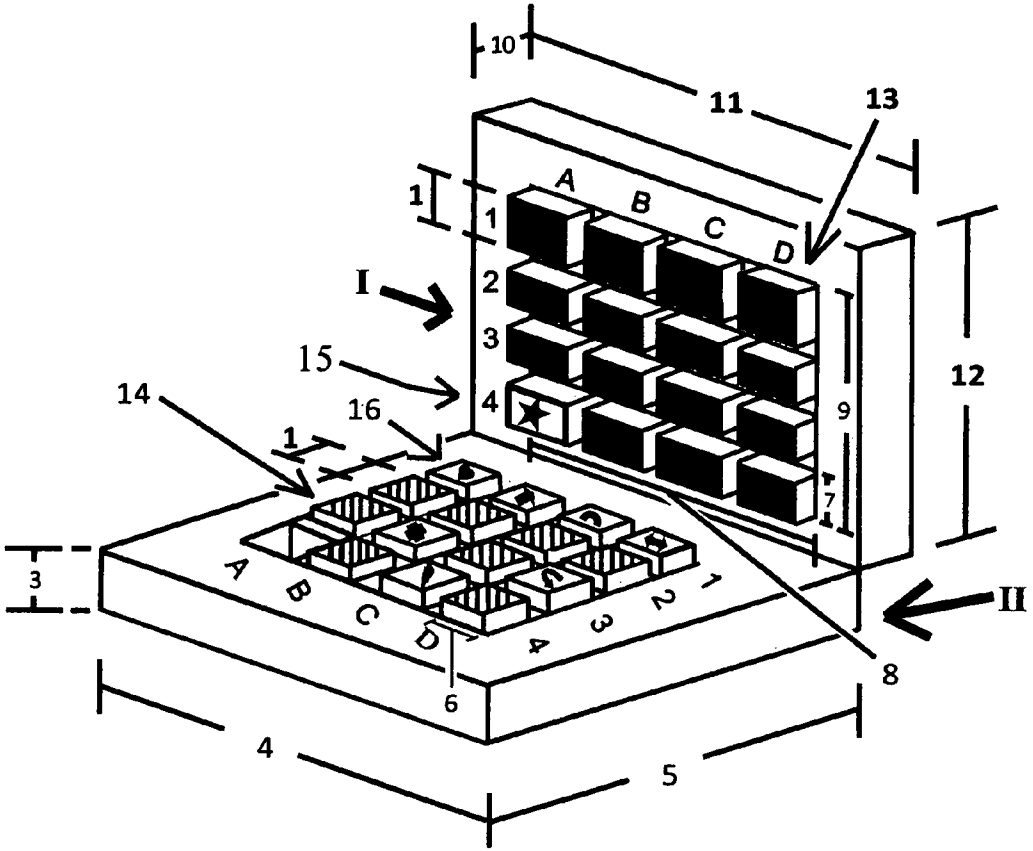
FIG. 32 presents the Player B game board with the star marked game piece 15 fully inserted into the corresponding A4 coordinate on the upper, vertical grid.
Figure 33:
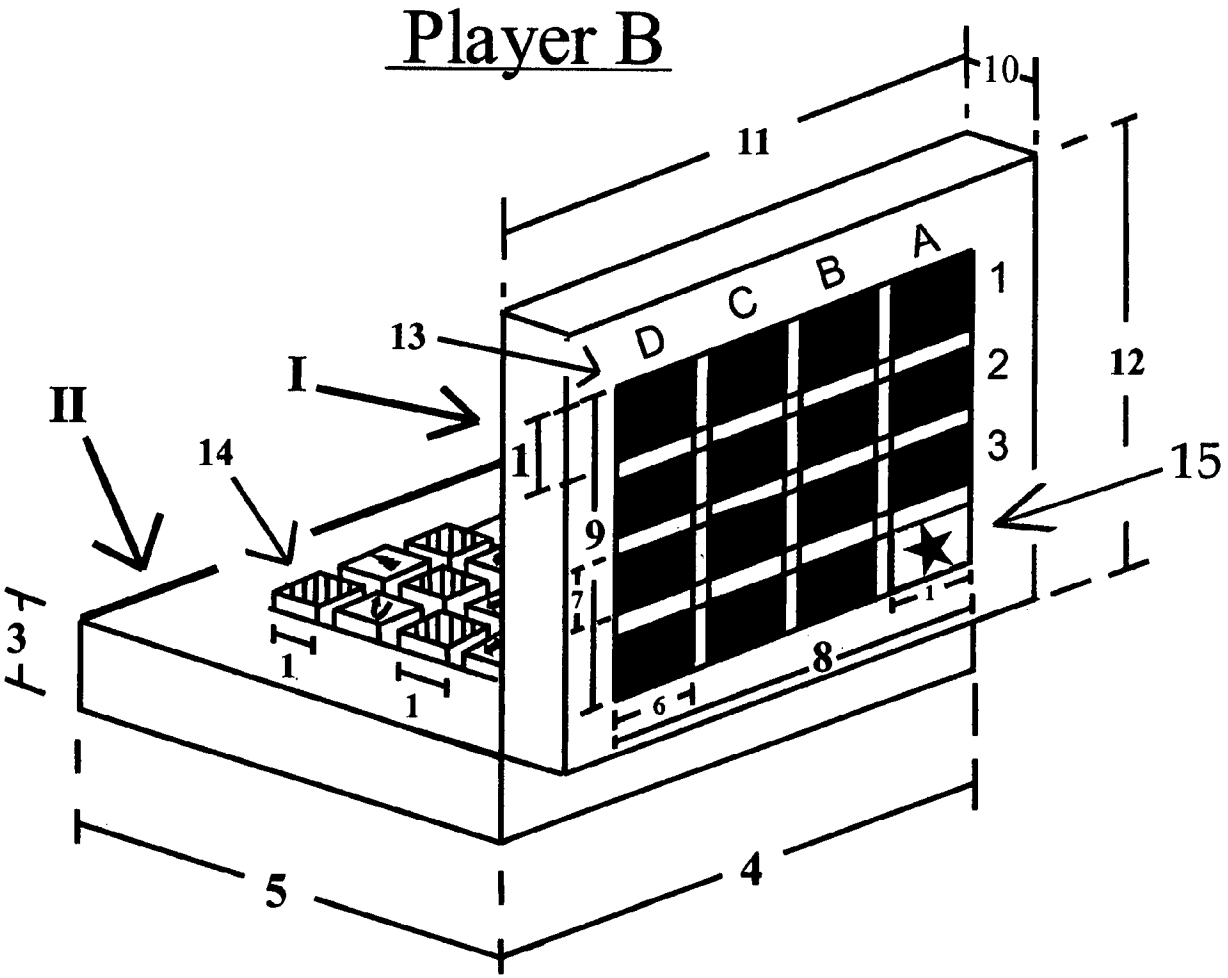
FIG. 33 shows the Player B game board with the star marked game piece 15 fully inserted into the A4 space from the reverse perspective that would be seen by all other opponents.

In seeing the question mark in the A4 spot (FIG. 30) the opponent(s) now have the opportunity to correctly guess what symbol-marked piece in fact occupies the A4 space. Ultimately, an opponent does guess the correct game element on the A4 space. Player B removes the game element from A4 (FIG. 31) and fully inserts that into the corresponding coordinate in the upper, vertical playing field (FIG. 32). All players now see the star marked game piece 15 in the A4 space (FIG. 33)

The addition of the question mark 19 into the game enables the child to think beyond a mere "hit" or "miss" competition. This brings the game apparatus presented in this disclosure up to a point where six year old children can play with increased challenge. The purpose is to assist the child to the next stage of cognitive reasoning development. The next level of gameplay beyond this point would naturally be the invention presented by M. Benedict III in patent number U.S. Pat. No. 7,665,735 B2, along with other educational based tools for the eight year old age group.

What is being claimed is:

1. A Nim game apparatus comprising:

a rectangular closable-type playing board, the rectangular closable-type playing board including a rectangular lid and a rectangular bottom board which are both of congruent length, height, and width, wherein a rectangular lid and a rectangular bottom board are hinged together on one side so as to be closed, and when opened to an approximate ninety-degree angle then reveal three separate playing fields each of congruent dimensions, with each playing field being a rectangular grid defined by a predetermined number of rows and columns which are sectioned into individual unit spaces, with each playing field having an equal number of rows, columns, and unit spaces, and where each unit space of each grid is of congruent dimensions;

a flat panel, of a length and a height congruent to a length and a height of a rectangular bottom board, which is attached to an underside of a rectangular bottom board;

a first playing field, located inside a rectangular closable-type playing board on a surface of a rectangular bottom board, that is used as an action area for inserting and removing a first set and a second set of game pieces, wherein each individual unit space coordinate of a first playing field is a rectangular socket, from individual unit space coordinates of a first playing field;

a second playing field, located inside a rectangular closable-type playing board on a surface underneath a lid, that is used as a recording area for inserting and removing a first set, a second set, and a third set of game pieces, wherein each individual unit space coordinate of a second playing field is a rectangular socket, from individual unit space coordinates of a second playing field, and where each rectangular socket of each individual unit space coordinate of a second playing field has an aperture extending entirely through a rectangular lid so that each aperture of a second playing field coordinate matches a corresponding coordinate of a third playing field on an opposite side on top of a surface of a lid;

a third playing field, located on top of a surface of a lid, that is used as a display area for inserting and removing a first set, a second set, and a third set of game pieces, wherein each individual unit space coordinate of a third playing field is a rectangular socket, from individual unit space coordinates of a third playing field, and where each rectangular socket of each individual unit space coordinate of a third playing field has an aperture extending entirely through a rectangular lid so that each aperture of a third playing field coordinate matches a corresponding coordinate of a second playing field on an opposite side underneath a lid, so that game pieces initially inserted in a coordinate from underneath a lid may pass entirely through a lid and be ejected out the corresponding coordinate of a third playing field on an opposite side on top of a surface of a lid;

a perimeter of space equal to one row of grid units surrounding all three playing fields such that one side above and one side to the left or right of each playing field grid are marked with alphanumeric symbols for the purpose of coordinate identification;

three sets of game pieces in the form of rectangular blocks which measure a length and height dimension less than a length and height dimension of each individual unit space coordinate, but whose width is greater than the width of either a rectangular lid or a rectangular bottom board, and wherein a first set of game pieces has a shape imprinted onto both ends, with that shape being duplicated on both ends, of a rectangular block, and which are inserted into and removed from individual unit space coordinates of a first, a second, and a third playing field grids;

a second set of game pieces in the form of rectangular blocks which measure a length and height dimension that is less than a length and height dimension of each individual unit space coordinate, but whose width is greater than the width of either a rectangular lid or a rectangular bottom board, and wherein a second set of game pieces has a red surface imprinted on both ends, with that red surface being duplicated on both ends, of a rectangular block, and which are inserted into and removed from individual unit space coordinates of a first, a second, and a third playing field grids, to indicate a coordinate selected by a player where no first set game piece had been prepositioned by an opponent on a corresponding coordinate in a first playing field;

a third set of game pieces in the form of rectangular blocks which measure a length and height dimension that is less than a length and height dimension of each individual unit space coordinate, but whose width is greater than the width of either a rectangular lid or a rectangular bottom board, and wherein a third set of game pieces has a black surface imprinted on both ends, with that black surface being duplicated on both ends, of a rectangular block, and which are inserted into and removed from individual unit space coordinates of a second and a third playing field grids to indicate an individual unit space coordinate that has not currently been selected during competition of the game, and a chart that illustrates what symbols are imprinted on a first set of game pieces which are inserted into and removed from coordinates of a first playing field, and which are the targets of opponents during game competition.

2. The game apparatus of claim 1 further including a perimeter of space equal to one row of grid units surrounding all three playing fields such that at least one side of each grid is marked with shapes for the purpose of coordinate identification.

3. The game apparatus of claim 1 further including a perimeter of space equal to one row of grid units surrounding all three playing fields such that at least one side of each grid is marked with colors for the purpose of coordinate identification.

4. The game apparatus of claim 1 further including a perimeter of space equal to one row of grid units surrounding all three playing fields such that at least one side of each grid is marked with persons or characters for the purpose of coordinate identification.

5. The game apparatus of claim 1 further including game pieces in a form of rectangular blocks which measure dimensions less than a length and height of each individual unit space coordinate of a playing field, but whose width is greater than the width of either a rectangular lid or a rectangular bottom board, and wherein the game pieces have a letter imprinted and duplicated on both ends.

6. The game apparatus of claim 1 further including game pieces in a form of rectangular blocks which measure dimensions less than a length and height of each individual unit space coordinate of a playing field, but whose width is greater than the width of either a rectangular lid or a rectangular bottom board, and wherein the game pieces have a number imprinted and duplicated on both ends.

7. The game apparatus of claim 1 further including game pieces in a form of rectangular blocks which measure dimensions less than a length and height of each individual unit space coordinate of a playing field, but whose width is greater than the width of either a rectangular lid or a rectangular bottom board, and wherein the game pieces have a color imprinted and duplicated on both ends.

8. The game apparatus of claim 1 further including game pieces in a form of rectangular blocks which measure dimensions less than a length and height of each individual unit space coordinate of a playing field, but whose width is greater than the width of either a rectangular lid or a rectangular bottom board, and wherein the game pieces have a person or character imprinted and duplicated on both ends.

9. The game apparatus of claim 1 further including game pieces in a form of rectangular blocks which measure dimensions less than a length and height of each individual unit space coordinate of a playing field, but whose width is greater than the width of either a rectangular lid or a rectangular bottom board, and wherein the game pieces have a question mark imprinted and duplicated on both ends.

* * * * *